US012167796B2

(12) United States Patent
DeJule

(10) Patent No.: US 12,167,796 B2
(45) Date of Patent: Dec. 17, 2024

(54) HUMAN SUPPORT STRUCTURE

(71) Applicant: Aaron DeJule, River Forest, IL (US)

(72) Inventor: Aaron DeJule, River Forest, IL (US)

(73) Assignee: Aaron DeJule, River Forest, IL (US)

( * ) Notice: Subject to any disclaimer, the term of this patent is extended or adjusted under 35 U.S.C. 154(b) by 0 days.

(21) Appl. No.: 16/680,225

(22) Filed: Nov. 11, 2019

(65) Prior Publication Data

US 2020/0085196 A1 Mar. 19, 2020

Related U.S. Application Data

(63) Continuation-in-part of application No. 15/584,580, filed on May 2, 2017, now Pat. No. 10,470,576.

(60) Provisional application No. 62/354,428, filed on Jun. 24, 2016, provisional application No. 62/331,716, filed on May 4, 2016.

(51) Int. Cl.

| | |
|---|---|
| ***A47C 1/00*** | (2006.01) |
| ***A47C 3/025*** | (2006.01) |
| ***A47D 9/02*** | (2006.01) |

(52) U.S. Cl.

CPC ..... *A47C 3/0251* (2018.08); *A47D 9/02* (2013.01); *A47D 9/057* (2022.08)

(58) Field of Classification Search

CPC ..... A47C 1/0355; A47C 1/031; A47C 1/0342; A47C 1/035; B60N 2/045; B60N 2/1615; B60N 2/162; B60N 2/507; B60N 2/508; B60N 2/1814; B60N 2/1817; B25J 17/0216; B23Q 1/5462

See application file for complete search history.

(56) References Cited

U.S. PATENT DOCUMENTS

| | | | | | |
|---|---|---|---|---|---|
| 257,873 | A ‡ | 5/1882 | Klein | A47C 3/0255 | 297/280 |
| 285,665 | A ‡ | 9/1883 | Peck | A47C 3/0255 | 297/278 |
| 402,469 | A ‡ | 4/1889 | Messmore | A47C 3/0255 | 297/278 |
| 523,337 | A ‡ | 7/1894 | Ebert | A47D 9/00 | 5/101 |
| 596,451 | A ‡ | 12/1897 | Babcock | A47C 3/0255 | 297/281 |
| 616,697 | A ‡ | 12/1898 | Cowles et al. | A47D 13/107 | 248/595 |

(Continued)

*Primary Examiner* — Kyle J. Walraed-Sullivan

(74) *Attorney, Agent, or Firm* — Andrus Intellectual Property Law, LLP

(57) ABSTRACT

A human support structure has: at least one support against which at least one part of a human body is borne; a base; a first motion transmitting assembly having first and second link members joined to each other and two components for pivoting movement around separate axes and defining a first unit; and a second motion transmitting assembly having third and fourth link members and two components joined together for pivoting movement around separate axes and defining a second unit. The first and second motion transmitting assemblies guide relative movement between the at least one support and the base. The first and second units can be selectively repositioned to change how relative movement between the at least one support and base is guided.

20 Claims, 12 Drawing Sheets

(56) References Cited

U.S. PATENT DOCUMENTS 998,689 A ‡ 7/1911 Irvine ..... A47C 3/0255 5/121
1,325,358 A ‡ 12/1919 Elzey ..... A47C 3/0255 248/327
1,379,082 A ‡ 5/1921 Cavanaugh ..... A47D 13/105 297/280
1,557,498 A ‡ 10/1925 Looney ..... A47D 13/105 297/181
1,740,949 A ‡ 12/1929 Luery ..... A47D 13/105 297/174 R
3,288,421 A ‡ 11/1966 Peterson ..... B23Q 1/5462 108/4
3,577,659 A * 5/1971 Kail ..... B25J 17/0216 434/58
4,304,437 A ‡ 12/1981 Longo ..... A63G 9/12 297/277
4,452,446 A ‡ 6/1984 Saint ..... A47D 13/105 472/119
4,996,732 A ‡ 3/1991 Chang ..... A47D 9/02 5/101
5,376,053 A ‡ 12/1994 Ponder ..... A63G 9/16 472/119
5,704,882 A ‡ 1/1998 Coates ..... A47C 3/0252 297/273
6,030,039 A ‡ 2/2000 Essler ..... A47C 15/008 128/845
6,030,386 A * 2/2000 Taylor ..... A61B 17/62 606/56
6,478,267 B1 ‡ 11/2002 Whitman ..... B60N 2/3097 248/157
6,896,575 B2 ‡ 5/2005 Fair ..... A63H 33/006 297/16.1
6,942,487 B2 ‡ 9/2005 Corbalis ..... A63B 69/0093 280/818
6,958,017 B1 ‡ 10/2005 Toombs, Jr. ..... A63G 9/00 297/273
7,367,068 B2 ‡ 5/2008 Huff ..... A45F 3/22 472/118
RE40,914 E * 9/2009 Taylor ..... A61B 17/62 606/56
7,666,126 B2 ‡ 2/2010 Rempe ..... A63B 22/18 482/121
7,806,697 B2 * 10/2010 Mallaci ..... G09B 9/02 434/372
8,074,369 B2 ‡ 12/2011 McMurtry ..... B25J 17/0266 33/503
8,333,766 B2 * 12/2012 Edelhauser ..... A61B 17/62 606/56
9,068,622 B2 ‡ 6/2015 Malchev ..... F16F 15/027
D735,819 S ‡ 8/2015 Louis ..... D21/686
9,242,181 B2 * 1/2016 Vatcher ..... A63G 31/02
9,536,446 B2 ‡ 1/2017 Vatcher ..... A63G 31/16
9,717,528 B2 * 8/2017 Singh ..... A61B 17/62
9,895,167 B2 * 2/2018 Edelhauser ..... A61B 34/10
9,925,101 B2 ‡ 3/2018 Kuenzler ..... A47C 20/04
9,943,725 B2 ‡ 4/2018 Todd ..... A63B 21/4033
10,010,350 B2 * 7/2018 Mannanal ..... A61B 17/62
11,150,731 B2 * 10/2021 Amin-Shahidi ..... G06F 3/016
2005/0176340 A1 ‡ 8/2005 Gubitosi ..... A47D 13/105 446/227
2006/0079378 A1 ‡ 4/2006 Ader ..... A63B 5/16 482/26
2006/0237885 A1 * 10/2006 Paillard ..... B60N 2/508 267/140.15
2007/0040431 A1 ‡ 2/2007 Bapst ..... A47D 13/105 297/274
2007/0049930 A1 * 3/2007 Hearn ..... A61B 17/66 606/56
2007/0102968 A1 ‡ 5/2007 Pearse ..... A47C 7/024 297/158.1
2007/0205646 A1 ‡ 9/2007 Bapst ..... A47D 9/02 297/261.1
2007/0262627 A1 ‡ 11/2007 Clapper ..... A47D 9/02 297/260.2
2007/0267904 A1 * 11/2007 Clapper ..... A47D 9/02 297/256.16
2007/0295882 A1 * 12/2007 Catton ..... B60N 2/508 248/588
2008/0012409 A1 ‡ 1/2008 Chen ..... A47D 13/107 297/274
2009/0036225 A1 ‡ 2/2009 Tseng ..... A47C 3/0255 472/125
2009/0134557 A1 * 5/2009 Spangler ..... B60N 2/38 267/131
2009/0230743 A1 ‡ 9/2009 Derakhshan ..... A47C 9/002 297/329
2009/0236886 A1 ‡ 9/2009 Tseng ..... A47C 3/0255 297/281
2010/0052376 A1 ‡ 3/2010 Hopke ..... A47D 9/02 297/188.01
2010/0279783 A1 ‡ 11/2010 Tseng ..... A47C 3/0255 472/118
2010/0312243 A1 * 12/2010 Ross ..... A61B 17/64 606/56
2010/0320821 A1 ‡ 12/2010 Trapp ..... A47D 13/107 297/274
2011/0018320 A1 * 1/2011 Schneider ..... B60N 3/063 297/216.17
2011/0032090 A1 * 2/2011 Provancher ..... G06F 3/03545 340/407.1
2011/0118738 A1 * 5/2011 Vasta ..... A61B 17/62 606/56
2011/0233975 A1 * 9/2011 Mindel ..... B60N 2/42709 297/216.17
2011/0319181 A1 ‡ 12/2011 Miller ..... A63G 9/16 472/119
2012/0175928 A1 ‡ 7/2012 Eber ..... A47C 3/0255 297/311
2012/0264530 A1 ‡ 10/2012 Gilbert ..... A47D 13/105 472/118
2013/0093227 A1 ‡ 4/2013 Mendes ..... A47D 13/107 297/274
2013/0154324 A1 * 6/2013 Xu ..... A47D 13/105 297/259.3
2013/0184088 A1 ‡ 7/2013 Haut ..... A47D 13/10 472/119
2013/0244803 A1 ‡ 9/2013 Haut ..... A47D 9/02 472/119
2013/0306826 A1 ‡ 11/2013 Pleiman ..... A47B 81/00 248/423
2014/0018179 A1 ‡ 1/2014 Mountz ..... A47D 13/105 472/119
2014/0091191 A1 * 4/2014 Romera Carrion ..... A47C 3/20 248/421
2014/0265490 A1 ‡ 9/2014 Hopke ..... A47D 9/02 297/260.2
2014/0287846 A1 ‡ 9/2014 Mountz ..... A47D 9/02 472/118
2015/0048667 A1 ‡ 2/2015 DeJule ..... A47C 7/00 297/46
2015/0174450 A1 ‡ 6/2015 Jhang ..... A63B 69/0093 482/146
2015/0265068 A1 ‡ 9/2015 Ferraro ..... A47D 13/105 472/118
2015/0343924 A1 ‡ 12/2015 Takeuchi ..... B60N 2/39 297/314
2016/0082870 A1 * 3/2016 Fujita ..... B60N 2/54 248/561
2016/0206096 A1 ‡ 7/2016 Chen ..... A47C 7/66
2016/0207430 A1 * 7/2016 Haller ..... B60N 2/0232
2016/0214658 A1 * 7/2016 Haller ..... B60N 2/522
2016/0286977 A1 ‡ 10/2016 Thomson ..... A47D 1/004
2017/0208964 A1 ‡ 7/2017 Luginin ..... A47D 9/02
2017/0280891 A1 ‡ 10/2017 Mountz ..... A47D 13/105

* cited by examiner
‡ imported from a related application

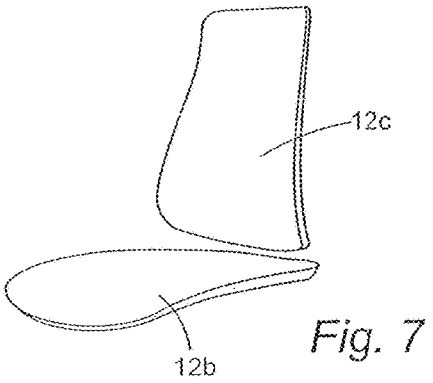
Fig. 7
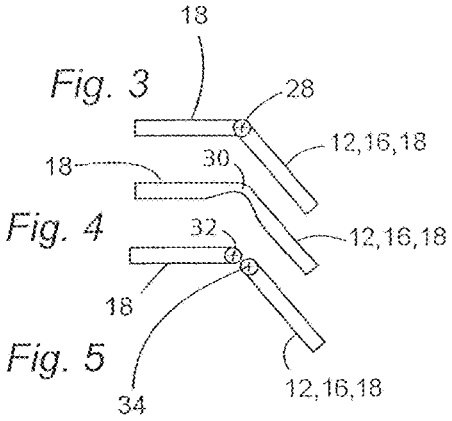
Fig. 3
Fig. 4
Fig. 5
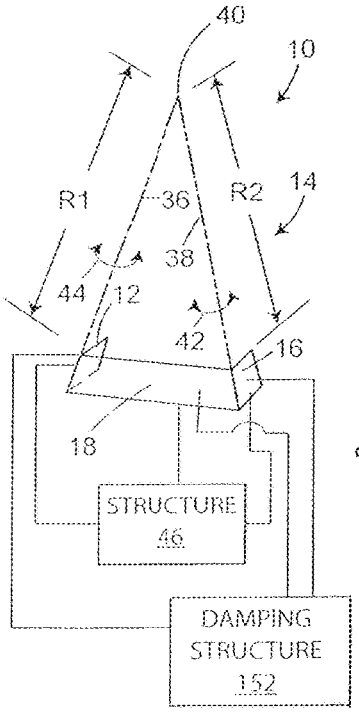
Fig. 8
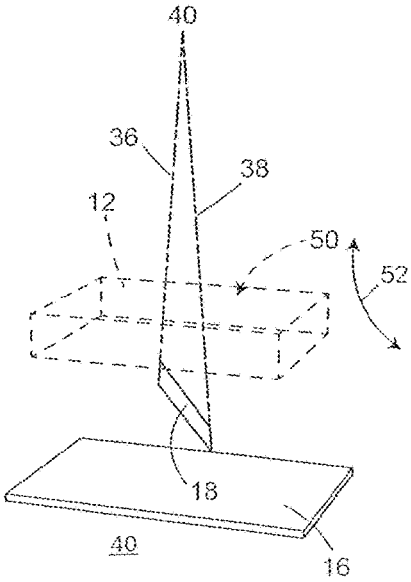
Fig. 9
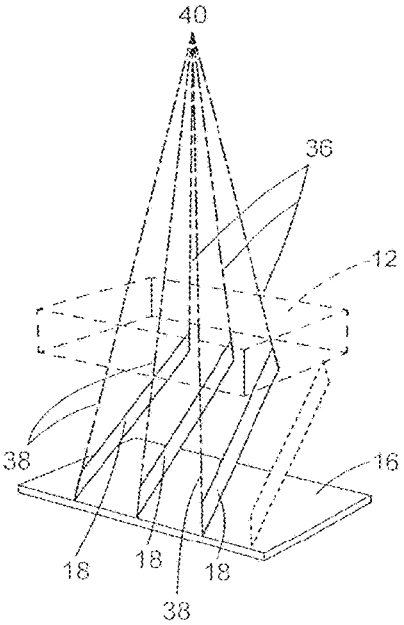
Fig. 10

Fig. 15
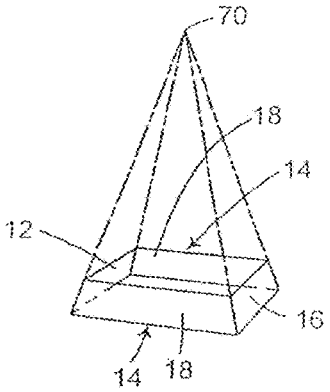
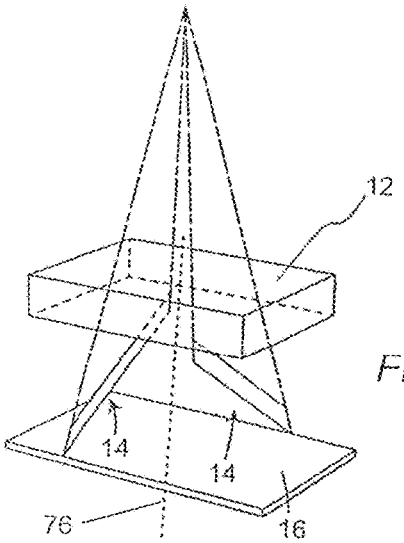
Fig. 17
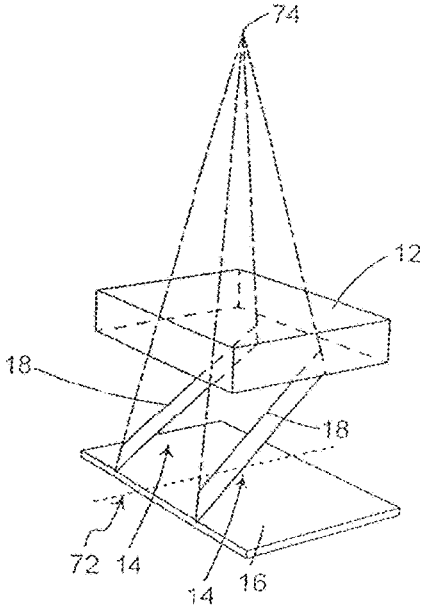
Fig. 16
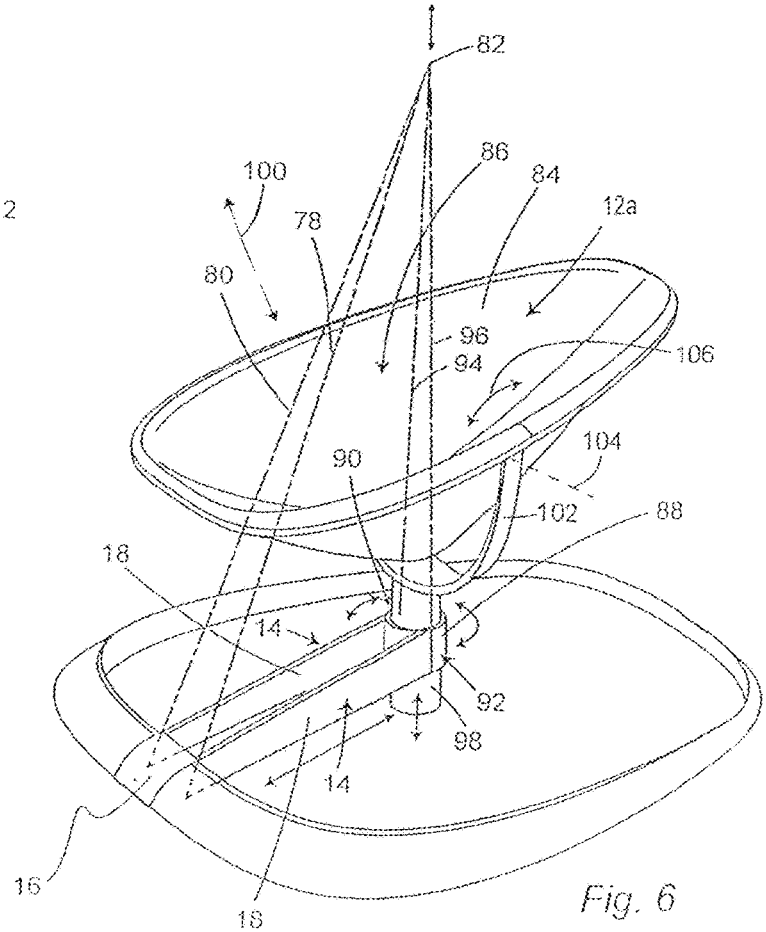
Fig. 6

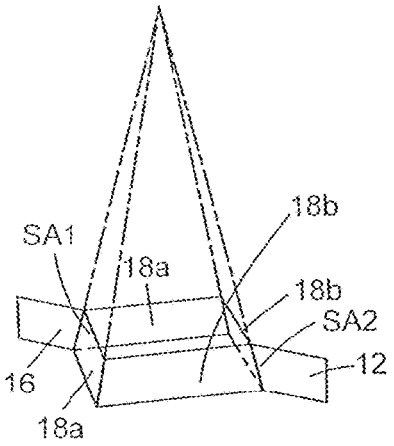
Fig. 22
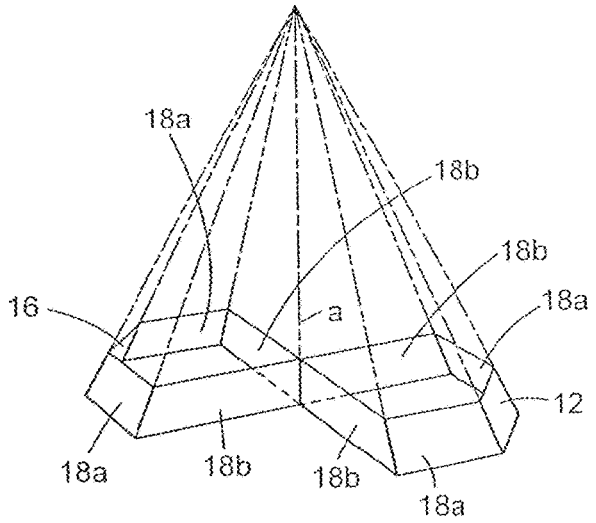
Fig. 24
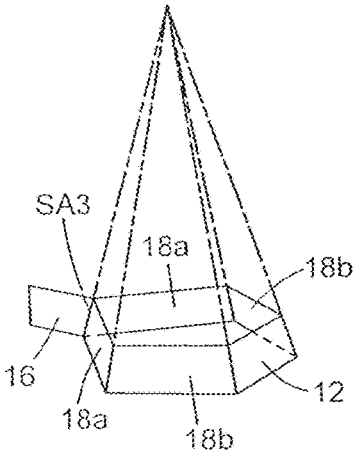
Fig. 23
Fig. 18
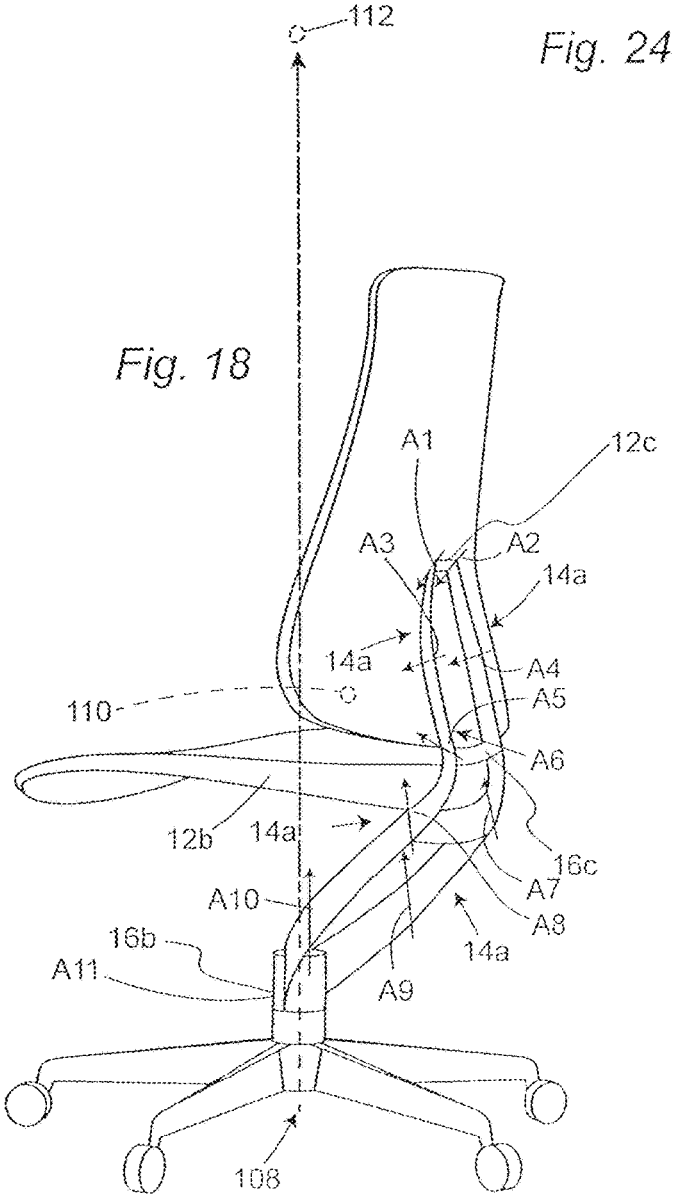

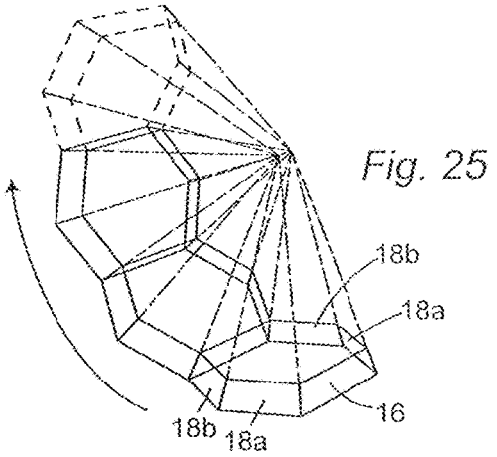
Fig. 25
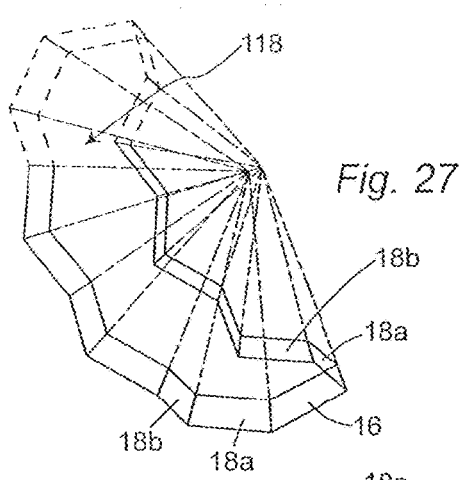
Fig. 27
Fig. 26
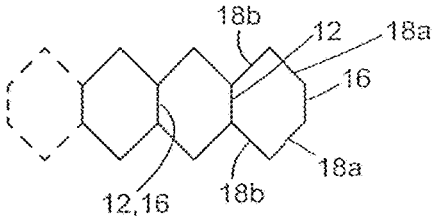
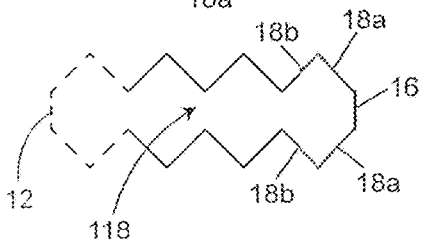
Fig. 28
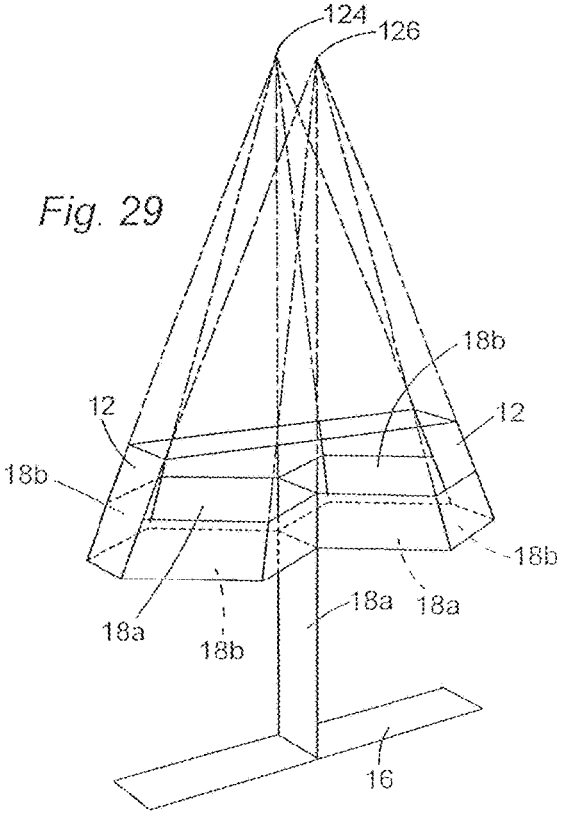
Fig. 29
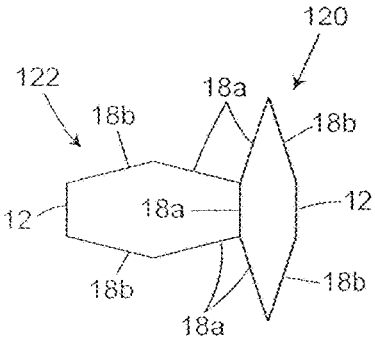
Fig. 30

HUMAN SUPPORT STRUCTURE

CROSS-REFERENCE TO RELATED APPLICATIONS

This application is a continuation-in-part of U.S. patent application Ser. No. 15/584,580 filed May 2, 2017, which claims priority to U.S. Provisional Patent Application Nos. 62/331,716 filed May 4, 2016 and 62/354,428 filed Jun. 24, 2016.

BACKGROUND OF THE INVENTION

Field of the Invention

This invention relates to structures for supporting part or all of a user and, more particularly, to a structure that allows the support to be controllably moved in different paths/manners.

Background Art

Decades of research studies indicate that a repetitive rocking motion has a positive effect on people of all ages. The rocking motion has been shown to benefit those suffering from various ailments, to the extent that some have adopted the label "Rocking Chair Therapy".

In one 1998 study of nursing home residents, University of Rochester School of Nursing, researchers found that patients with Alzheimer's disease who rock for 1-2 hour per day in a chair "demonstrated significant improvements in depression, anxiety, and balance and a decrease in pain medication usage." In another study, researchers demonstrated rocking improved circulation to the brain. Some physiotherapists claim rocking may produce a sedative effect and aid in pain management, easing lower back pain. The potential benefits extend to the relief of psychological symptoms of anxiety and depression.

However, rocking back and forth on curved slats bearing against a rigid surface causes a jerking motion—thereby detracting from the rocking experience.

It is commonly known that infants and babies have been soothed in automated infant swings and nursery rocking/gliding chairs for many years. Today, according to the National Center for Health Statistics (NCHS) in the United States, the fast pace of modern lifestyles and increasingly career-oriented mothers are driving a preference for convenience and the need for "time-saving and easy-to-use" baby care devices. Industry challenges are associated with child safety including the risk of falls, posture, and the like.

A variety of apparatus incorporate swinging, gliding, rocking or bouncing motion to provide users—from infant to adult—with relaxation, comfort, improved circulation and other benefits. In a sitting, prone, or upright position, current designs for infants and baby swings commonly provide either front-to-back or side-to-side motion.

In one common swing configuration, a seat or cradle is attached and suspended above the ground from the top of a frame where a motor is located to create an arcuate swinging motion. The motor may be adjacent to the center of a radius for the arc. To take advantage of a full range of swinging motion and benefit from a longer smoother swing, the center/pivot point of the frame must be positioned a substantial distance above the seated user. The overall frame must thus be made correspondingly larger to provide a stable support. Current manufacturers offer small-medium-large designs. Taller swings may be top heavy, thus presenting safety concerns. Furthermore, the motor and lines of attachment residing above the user may serve to block visibility of, for example, an infant in distress, and limit immediate access when necessary.

In another common configuration, a cradle or seat is provided on a frame and attached on the sides thereof to enable front-to-back and/or side-to-side motion in a glider design. In contrast to attaching a seat or cradle from above the seated user, the gliding design configurations limit motion to short, front-to-back or side-to-side. While the seated user is not obstructed from view or accessibility, structural parts of the frame may trap or pinch a body part of the user.

Among the various designs for adult rocking, gliding chairs, and baby swings and gliders, each affords less than optimal comfort, health benefits, economy of space, and/or safety. In addition to safety issues, bulk configurations, large footprints and complex motion mechanisms, such apparatus may not be practical for small living quarters such as apartments.

A number of different mechanisms have been devised by the inventor herein to allow repositioning of supports for one or more parts of a user, as in a standard sitting position on a sitting surface. The support may be in the form of a backrest, an armrest, a primary seating surface, etc. While great strides have been made by the inventor in terms of allowing unique movements of these supporting surfaces to be more convenient, comfortable, and desirable for the user, the seating industry continues to face the challenge of devising a single design that will accommodate the vast majority of users, within a range of body styles, intended uses, and desired movements. The challenge of coming up with a generic design is complicated by the demands imposed by the many different applications—ranging from business/office, classroom, gaming, etc.

SUMMARY OF THE INVENTION

In one form, the invention is directed to a human support structure having: at least one support against which at least one part of a human body can be borne in use; a base; a first motion transmitting assembly; and a second motion transmitting assembly. The first motion transmitting assembly has first and second link members joined to each other for pivoting movement around a first shared axis and defining a first unit. The first link member is joined to a component for pivoting movement around a first axis. The second link member is joined to a component for pivoting movement around a second axis. A second motion transmitting assembly has third and fourth link members joined to each other for pivoting movement around a second shared axis and defining a second unit. The third link member is joined to a component for pivoting movement around a third axis. The fourth link member is joined to a component for pivoting movement around a fourth axis. The first and second motion transmitting assemblies cooperate between at least one of: a) each other; b) at least two of the at least one support; and c) the base and at least one support to guide relative movement between the at least one support and the base. The human support structure is configured so that the first and second units can be selectively and controllably relatively repositioned to change how relative movement between the at least one support and base is guided.

In one form, the first and second axes converge towards a first location.

In one form, the third and fourth axes converge towards a second location.

In one form, the human support structure is configured so that the first location can be selectively changed.

In one form, the human support structure is configured so that at least one of the first and second units is pivotable relative to the other of the first and second units.

In one form, the human support structure is configured so that at least one of the first and second units is translatable relative to the other of the first and second units.

In one form, the third and fourth axes converge towards the first location.

In one form, the human support structure is configured so that the first location can be selectively changed.

In one form, the support is one of: a) a seat; b) an armrest; c) a back support surface; and d) a cradle for an infant.

In one form, the first unit additionally includes the components to which the first and second link members are joined.

In one form, the second unit additionally includes the components to which the third and fourth link members are joined.

In one form, one of the additional components to which one of the first and second link members is joined is pivotably connected to one of the additional components to which one of the third and fourth link members is joined in a manner to allow the first and second units to be relatively repositioned.

In one form, the human support structure further includes a drive for moving at least one of the first and second units to thereby effect relative repositioning of the first and second units.

In one form, only one of the additional components on the first unit is connected directly to the second unit.

In one form, the invention is directed to a human support structure having: at least one support against which at least one part of a human body can be borne in use; a base; a first motion transmitting assembly; and a second motion transmitting assembly. The first motion transmitting assembly has first and second link members joined to each other for pivoting movement around a first shared axis and defining a first unit. The first link member is joined to a component for pivoting movement around a first axis. The second link member is joined to a component for pivoting movement around a second axis. The second motion transmitting assembly has third and fourth link members joined to each other for pivoting movement around a second shared axis and defining a second unit. The third link member is joined to a component for pivoting movement around a third axis. The fourth link member is joined to a component for pivoting movement around a fourth axis. The first and second motion transmitting assemblies cooperate between at least one of: a) each other; b) at least one of the at least one support; and c) the base and at least one support to guide relative movement between the at least one support and the base. The first and second axes converge towards a first location. The human support structure is configured so that the first location can be changed.

In one form, the third and fourth axes converge towards the first location.

In one form, the human support structure has a seating surface. The human support structure is configured so that the first location can be changed relative to a user in a sitting position on the seating surface.

In one form, the component to which the first link member connects makes up part of the base. The component to which the second link member connects makes up part of the at least one support.

In one form, the component to which the third link member connects makes up part of the base. The component to which the fourth link member connects makes up part of the at least one support.

In one form, the human support structure is configured so that the first location can be shifted both vertically and horizontally relative to a user in a sitting position on the seating surface.

BRIEF DESCRIPTION OF THE DRAWINGS

FIGS. 3-5 show alternative forms of connectors between the base, support, and link members that allow relative movement therebetween around an axis;

FIG. 6 is a perspective view of one specific form of the human support structure, as shown schematically in FIG. 1, with the support in the form of an infant cradle;

FIG. 7 is a perspective view of a seat and backrest making up supports on a chair into which the invention can be incorporated;

FIG. 8 is a schematic representation of one form of motion transmitting assembly;

FIG. 9 is a schematic representation of the motion transmitting assembly as in FIG. 8 connected between a more specific form of base and support;

FIG. 10 is a schematic representation of a plurality of the motion transmitting assemblies, as in FIGS. 8 and 9, connecting between a support and base;

FIG. 15 is a schematic representation of a mirrored arrangement of motion transmitting assemblies, with the construction as in FIG. 11;

FIGS. 16 and 17 are schematic representations showing different arrangements of multiple motion transmitting assemblies, as shown in FIG. 11, connecting between supports and bases;

FIG. 18 is a perspective view of a task chair incorporating multiple motion transmitting assemblies, according to the invention to allow movement of a seat and backrest thereon;

FIGS. 22-30 are schematic representations of further alternative forms of human support structure incorporating different arrangements of motion transmitting assemblies;

DETAILED DESCRIPTION OF THE PREFERRED EMBODIMENT

Figure 1:
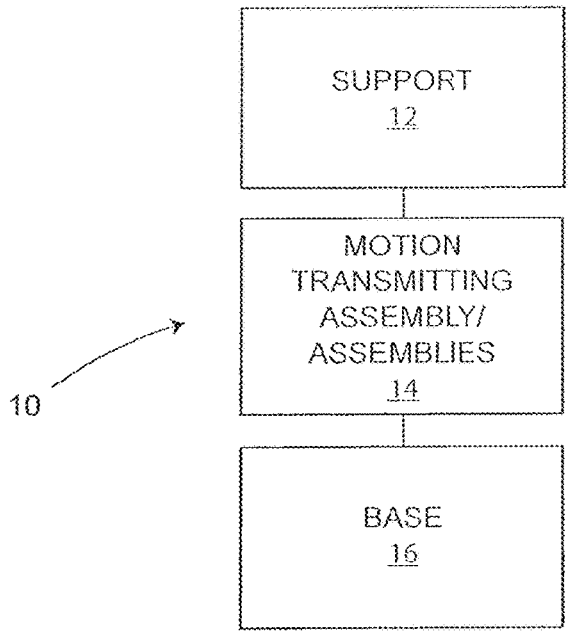
FIG. 1 is a schematic representation of a movable human support structure, according to the invention, and including a support on which all or part of a user can bear, a base, and at least one motion transmitting assembly connecting between the support and base.

In FIG. 1, a schematic representation of a movable human support structure, according to the present invention, is shown at 10. The structure 10 is designed to support all or part of an adult or infant human in a manner whereby the supported part(s) can be repeatedly moved in opposite directions in a controlled path.

The structure 10 includes a support 12 against which a part, or the entirety, of the user can be borne. One or more motion transmitting assemblies 14 acts between the support 12 and a base 16, which may be a fixed structure or a dedicated structure which makes the support 12, motion transmitting assembly/assemblies 14, and base 16 a self-contained unit that might be repositionable and/or transportable to different locations.

The schematic showing of the support 12 is intended to encompass virtually any structure that supports part or all of a user, regardless of size or age. As just examples, the support 12 may be a seat, a backrest, a crib, a chair, a baby seat, a stool, a playground swing, a harness support, a hammock, a horizontal lounge seat, etc. The structure can incorporate other features found in conventional swing products, such as rockers, gliders, baby swings, nursery chairs, playground swings, etc.

Figure 2:
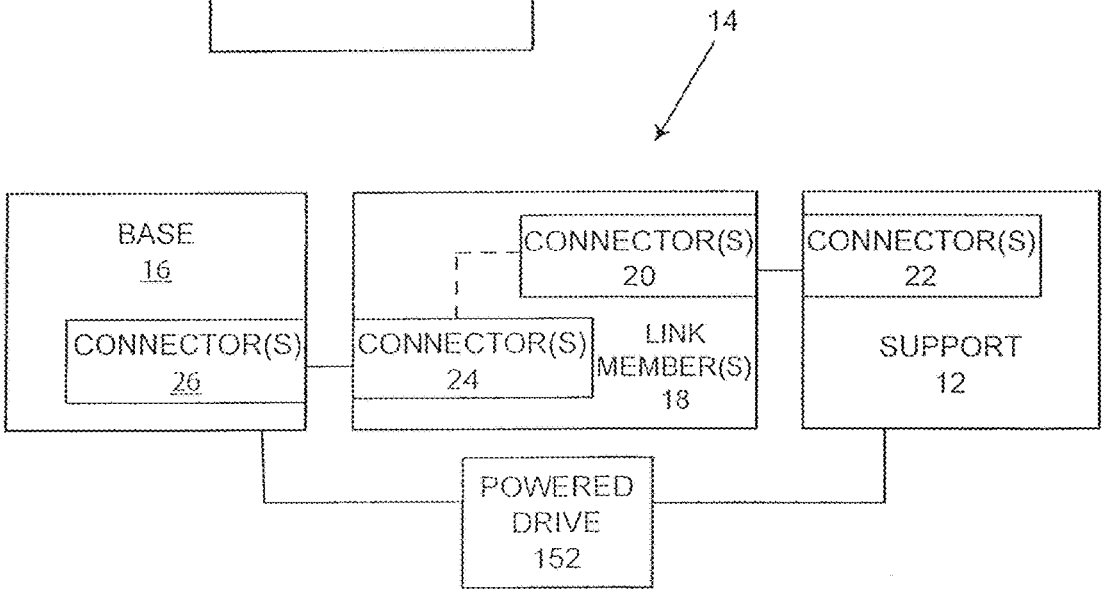
FIG. 2 is a schematic representation of the motion transmitting assembly in FIG. 1 and showing additional details thereof.

As shown in FIG. 2, one exemplary motion transmitting assembly 14 consists of at least one link member 18 acting between the base 16 and support 12. At least one connector 20 on one of the link members 18 is configured to cooperate with at least one connector 22 on the support 12. The connectors 20, 22 interact to guide movement between the link member 18 and support 12 around a common axis, or adjacent axes which, for purposes of simplifying the explanation herein, will be considered a single axis.

The same or another link member 18 has at least one additional connector 24 which cooperates with at least one connector 26 on the base 16 to guide relative movement between the link member 18 and base 16 around a separate axis.

The link member connectors 20, 24 may interact, when there is more than one link member 18 acting between the support 12 and base 16, to guide relative movement between the link members 18 around an additional axis.

At least two of the axes, and preferably all of the axes, in the motion transmitting assembly 14 are in non-parallel relationship to each other. In one preferred form as for a basic seating support 12, the axes are oriented primarily in a vertical direction.

The schematic showing of the connectors 20, 22, 24, 26 in FIG. 2 is intended to encompass virtually an unlimited number of different configurations thereof. Exemplary connector structures, which are not intended to be limiting, are shown in FIGS. 3-5.

As shown in FIG. 3, a link member 18 is connected to a support 12, base 16, or another link member 18 for pivoting movement around a fixed single axis 28.

FIG. 4 shows an alternative pivot connection wherein one link member 18 is connected to the support 12, base 16, or another link member 18 through a live hinge arrangement through which the components are effectively moved relative to each other around an axis 30.

FIG. 5 shows an arrangement of connectors wherein a link member 18 and the associated support 12, base 16, or separate link member 18, are movable independently about adjacent axes 32, 34. The axes 32, 34 are in close enough proximity that they can be treated as a single axis for purposes of the description and claims herein.

Similarly, while the live hinge arrangement does not produce a precise pivot action around a single line, the components will be considered, for purposes of simplicity herein, to be movable relative to each other around a single axis.

In another form, leaf springs and torsion bars might be utilized to turn one component relative to the other around an axis.

Ball-in-socket arrangements present another option. Within one design structure a mix and match of different rotational joints could be used. For example, one area can have molded parts with molded integrated hinges and another area of the design mechanical hinges. Similarly, the entire mechanism, including its axes, could be one molded part—for example, a co-injection part—allowing for flexibility at the hinges and rigidity at the linkages.

Exemplary forms of the support 12 are shown in FIGS. 6 and 7. FIG. 6 shows a support 12*a* in the form of an infant cradle.

In FIG. 7, separate supports 12*b*, 12*c* are shown as a seat, and a backrest, respectively, which may be usable for an infant or adult.

As noted above, the support 12 is not limited to any specific configuration. It is contemplated that virtually any element/surface against which part or all of a user bears, to be movable in opposite directions in a non-straight/non-linear path, may be combined with the motion transmitting assembly/assemblies 14 and base 16, as shown schematically in FIG. 1.

The precise construction of the link members 18 is not critical to the invention. Generally, each of the link members will be described as having a substantially rigid construction between spaced locations whereat the connectors 20, 24 are located. In numerous of the examples hereinbelow, the link members 18 are shows as generally flat panels with a generally polygonal peripheral shape. This is not a requirement.

A basic motion transmitting assembly, shown at 14 in FIG. 8, defines one form of basic "building block" that is usable alone, with a like motion transmitting assembly, and/or with other structure. The motion transmitting assembly 14 has a link member 18 joined to a support 12 and base 16 through appropriate connectors (details not shown but shown generically in FIG. 2) so that the link member 18 pivots relative to the support 12 around an axis 36 and the link member 18 and base 16 are movable relative to each other around a separate axis 38. The axes 36, 38 converge to, or towards, a pivot location 40.

Standing alone, the structure 10 in FIG. 8, shown to include the motion transmitting assembly 14, support 12, and base 16, is configured so that with the base 16 held in a fixed position, the support 12 traces a first arc by moving with the link member 18 around the axis 38, as indicated by the double-headed arrow 42. The support 12 traces a second arc by moving relative to the link member 18 around the axis 36, as indicated by the double-headed arrow 44.

Structure, shown generically at 46, may interact with the support 12, link member 18, and/or base 16 to control/alter the manner in which the support 12, link member 18, and base 16 move relative to each other. The structure 46 may take a variety of different forms and may include, for example, one or more additional motion transmitting assemblies, as hereinafter described, or other structure that may be manually or automatically operated either in response to a user's application of force upon the support 12 or independently of any outside influence.

The non-straight path may be controlled to be essentially arcuate with the FIG. 8 configuration with the radius of the arc being determined by the radii R1, R2, respectively between the pivot location 40 and the connection locations of the support 12 and link member 18 and link member 18 and base 16.

FIG. 9 shows a slightly more specific form of the base 16 and support 12, as shown generically in FIG. 8. As depicted, the support 12 is maintained in a spaced, elevated relationship with the base 16, that is maintained on a foundation 48 either movably or fixedly in relationship thereto. The support 12 defines an upwardly facing support region/surface at 50, which may be a seat, a cradle, etc. The link member 18 angles upwardly from the base 16 to maintain the support 12 in the elevated position shown. The link member 18 connects to the base 16 for relative movement about the axis 38, that is oriented primarily in a vertical direction. The support 12 is joined to the link member 18 for pivoting movement about the axis 36, also having primarily a vertical orientation. The axes 36, 38 converge at the aforementioned pivot location 40.

The support 12 can be moved back and forth in a path that is nominally arcuate, as indicated by the double-headed arrow 52. The path is actually a combination of the arcuate movements traced by the support 12, as indicated by the double-headed arrows 42, 44 in FIG. 8.

With the motion transmitting assembly 14, turning of components around the axis may facilitate collapsing of the structure 10, as for storage and/or transportation. This same concept can be used to reconfigure any of the embodiments with the different form of motion transmitting assembly, as described herein.

The basic building block shown in FIGS. 8 and 9 might be connected or duplicated by mirroring, rotating, patterning, offsetting, etc. Various axes and linkages may be strategically shared between the "building blocks", support 12 and base 16.

One exemplary form of the structure 46 in FIG. 8, combined with the basic building block/motion transmitting assembly 14, is shown in FIG. 10. Three like link members 18 are connected between the support 12 and base 16 in a manner that the axes 36, 38 associated with each of the "building blocks" converges to the pivot location 40. Each of the link members 18, together with the base 16 and support 12, makes up a separate motion transmitting assembly, with the motion transmitting assemblies interacting to produce a different permissible, non-straight path for the support 12, which can move back and forth in a controlled manner within this path.

Figure 11:
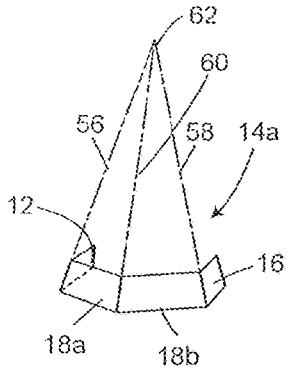
FIG. 11 is a view as in FIG. 8 of another form of motion transmitting assembly connecting between a base and support.

FIG. 11 depicts another form of building block/motion transmitting assembly 14*a* wherein there are separate link members 18*a*, 18*b* connecting between the support 12 and base 16.

The link member 18*a* is connected to the support 12 for pivoting movement relative thereto around an axis 56. The link member 18*b* is pivotable relative to the base 16 around an axis 58. The link members 18*a*, 18*b* are movable relative to each other around an axis 60. As depicted, the axes 56, 58, 60 converge towards a pivot location 62.

Figure 12:
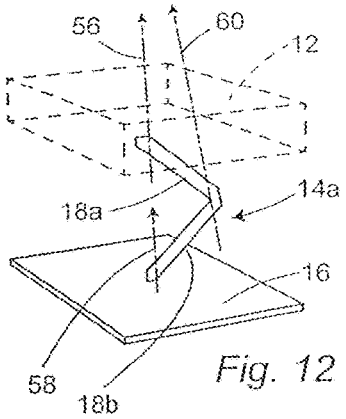
FIG. 12 is a schematic representation of the motion transmitting assembly in FIG. 11 connected between a more specific form of base and support.

FIG. 12 shows a more specific form of the motion transmitting assembly 14a in FIG. 11 associated with a support 12 and base 16 as in FIG. 9.

Figure 13:
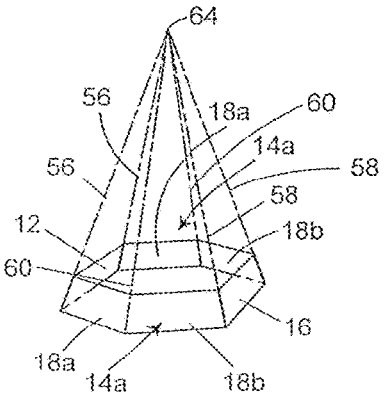
FIG. 13 is a view as in FIG. 11 wherein the motion transmitting assembly is in a mirrored arrangement with all pivot axes between components converging towards a single pivot point.

FIG. 13 shows a mirrored arrangement of the motion transmitting assemblies 14*a* in relationship to a support 12 and base 16. In FIG. 13, all axes 56, 58, 60 converge to or towards a single pivot location 64.

Figure 14:
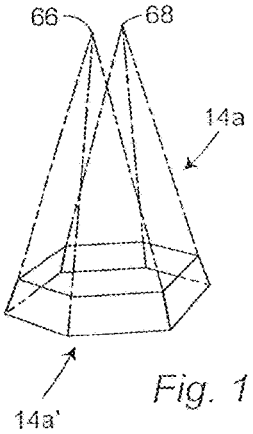
FIG. 14 is a view as in FIG. 13 showing a modified form of mirrored motion transmitting assembly wherein pivot axes converge towards spaced points.

FIG. 14 shows a modified form of the motion transmitting assemblies in FIG. 13 at 14*a*' wherein the axes on each of the motion transmitting assemblies 14*a*' converge towards different pivot locations 66, 68, which are spaced from each other.

FIG. 15 shows a mirrored arrangement of the motion transmitting assembly 14, as shown in FIG. 8, with all axes converging toward a single pivot location 70.

FIG. 16 shows a more specific form of a support 12 and base 16 with a mirrored arrangement of the motion transmitting assemblies 14. Symmetry is about the dotted line, as indicated by the arrow 72. All axes converge towards a single pivot location 74.

FIG. 17 shows a different arrangement of multiple motion transmitting assemblies 14 between a support 12 and base 16. The motion transmitting assemblies 14 are turned with respect to each other around an axis 76.

In FIG. 6, the mirrored arrangement of motion transmitting assemblies 14 is shown integrated into a more specific, exemplary form of support 12*a* and base 16. The base 16 is ring-shaped. The link members 18 are connected to the base 16 for movement around separate axes 78, 80 that converge towards a pivot location 82.

The support 12*a* has different parts including a main body 84 defining a receptacle 86, as for a user to sit or an infant to be placed in a cradling arrangement.

The support 12*a* further includes a mounting portion 88. The link members 18 are connected to the mounting portion 88 at diametrically opposite locations 90, 92 for pivoting movement around axes 94, 96, which likewise converge towards the pivot location 82.

The depicted axes 78, 80, 94, 96 have a fixed relationship with each other.

The body 84 has a depending stem 98 that telescopies within the mounting portion 88 to allow the height of the receptacle 86 to be changed relative to the base 16.

The motion transmitting assemblies 14 guide movement of the support 12*a* relative to the base 16 in a predetermined, non-straight path which, as depicted, is curved/arcuate, as indicated by the double-headed arrow 100. The support 12*a* tilts with respect to a horizontal reference plane. The tilt angle changes as it moves in the path.

In this embodiment, the stem 98 extends upwardly to a U-shaped holder 102 that straddles a main part of the body 84. The body 84 can be pivotably connected to the holder 102 to allow the inclination thereof to be changed by pivoting around an axis 104, as indicated by the double-headed arrow 106.

Additionally, the stem 98 may pivot relative to the mounting portion 88 around a vertical axis.

All cooperating, relatively movable components may include a feature whereby different relative positions may be releasably held. The user thus has substantial flexibility in terms of reconfiguring the overall structure as, for example, to change the height and/or orientation of the receptacle 86.

The stem 98 may be fixed relative to the mounting portion 88 in a desired relationship or, alternatively, the body 84 may be allowed to turn around a vertical axis as the support 12*a* is rocked in a back and forth motion, as indicated by the double-headed arrow 100.

In FIG. 18, the seat 12*b* and backrest 12*c* in FIG. 7 are shown incorporated into a wheeled carriage 108 using motion transmitting assemblies 14*a* to allow back and forth independent movement of the seat 12*b* and backrest 12*c*.

A mirrored arrangement of motion transmitting assemblies 14*a* is incorporated so that all pivot axes A1, A2, A3, A4, A5, A6 converge towards a pivot location at 110 that is at a hip of a user in a sitting position upon the seat 12*b*.

A mirrored arrangement of motion transmitting assemblies 14*a* is incorporated to support the seat 12*b* on the base 16*b*, atop the carriage 108, in a manner whereby the axes A7, A8, A9, A10, A11 converge towards a pivot location 112 that is above the backrest 12*c*. The axis A11 is a shared axis.

Thus, the seat 12*b* and backrest 12*c* can be moved independently of each other in separate back and forth non-straight paths relative to the carriage 108.

Figure 19:
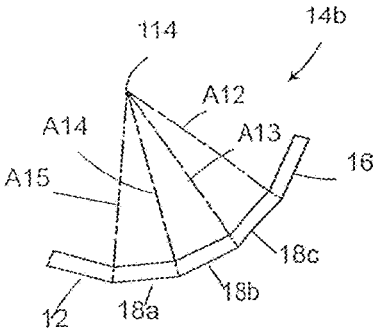
FIG. 19 is a schematic representation of another support structure according to the invention and with a motion transmitting assembly incorporating three link members between a support and base.

A further modified form of motion transmitting assembly is shown at 14*b* in FIG. 19 with three link members between a support and base 12, 16, respectively. All pivot axes A12, A13, A14, A15 converge towards a pivot location 114.

Figure 20:
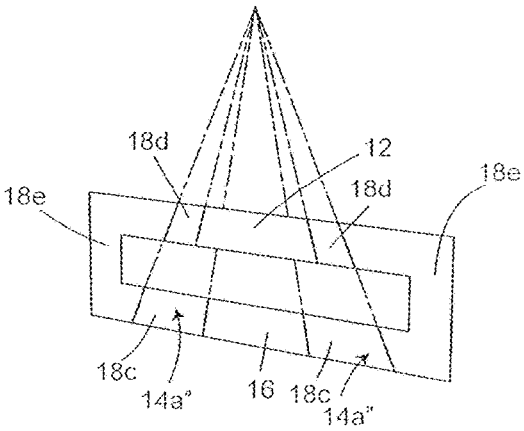
FIGS. 20 and 21 are schematic representations of an alternative form of human support structure using a different form of motion transmitting assembly and in two different states.
Figure 21:
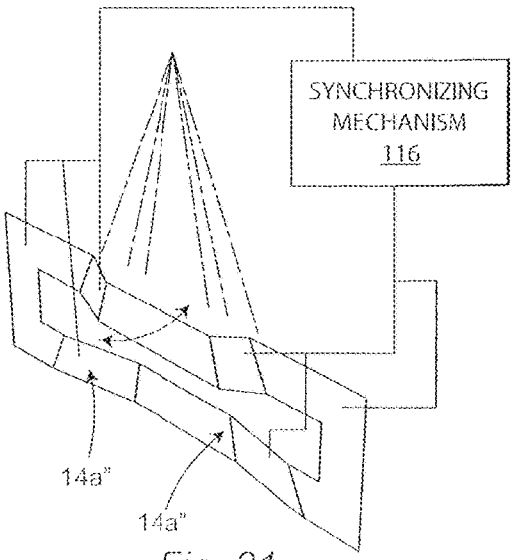

FIGS. 20 and 21 show a further form of movable human support structure that utilizes a mirrored arrangement of the modified form of the three axis motion transmitting assembly 14*a*, identified in FIGS. 20 and 21 as 14*a*" with link members 18*c*, 18*d*, 18*e*.

The support 12 moves in an arcuate path between the FIG. 20 and FIG. 21 states. In the FIG. 20 state, the link members 18*c*, 18*d* are coplanar. A synchronizing mechanism 116 may be incorporated to prevent binding or locking of the structure as it is changed from the FIG. 21 state to a state wherein the support 12 moves in its desired path over center past the coplanar relationship of FIG. 20. This allows the support 12 to move freely and smoothly back and forth through the full desired range of the non-linear path. The synchronizing mechanism 116 can be made using well-known technology, as by employing gears, pulleys/chains, belts, etc. As but one example, a link/component may connect between the link members 18*c*, 18*d*, 18*e* to achieve this objective. The link/component may be connected as by a hinge arrangement, ball and socket arrangement, etc. at its ends.

FIG. 22 shows a mirrored arrangement of motion transmitting assemblies, each with links 18*a*, 18*b* between a support 12 and base 16, and with two separate shared axes SA1, SA2.

FIG. 23 shows similar components 18*a*, 18*b*, 12, 16 with a single shared axis SA3 for the base 16.

FIG. 24 shows an arrangement of components 18*a*, 18*b*, 12, 16 wherein the link member 18*b* is one continuous part, connected with an axis a at its center.

Multiple motion transmitting assemblies, with the same or different forms, may be combined, with one exemplary arrangement shown in FIGS. 25 and 26 and another shown in FIGS. 27 and 28, each utilizing the same basic components as in the various embodiments described above—support 12, base 16, and link members 18*a*, 18*b*.

In FIGS. 25 and 26, the support 12 and base 16 are shared.

In FIGS. 27 and 28, there is no connecting structure between the link members 18*a*, 18*b* in a gap as identified at 118.

FIGS. 29 and 30 show a further modified form of structure with combined motion transmitting assemblies utilizing the basic components—18*a*, 18*b*, 12, 16 but in a different, mirrored configuration. Movement of the support 12 is effected by collapsing one side 120 with the other side 122 extended.

The axes may converge to spaced pivot points 124, 126, as shown, or may alternatively converge towards a single pivot point.

Figure 31:
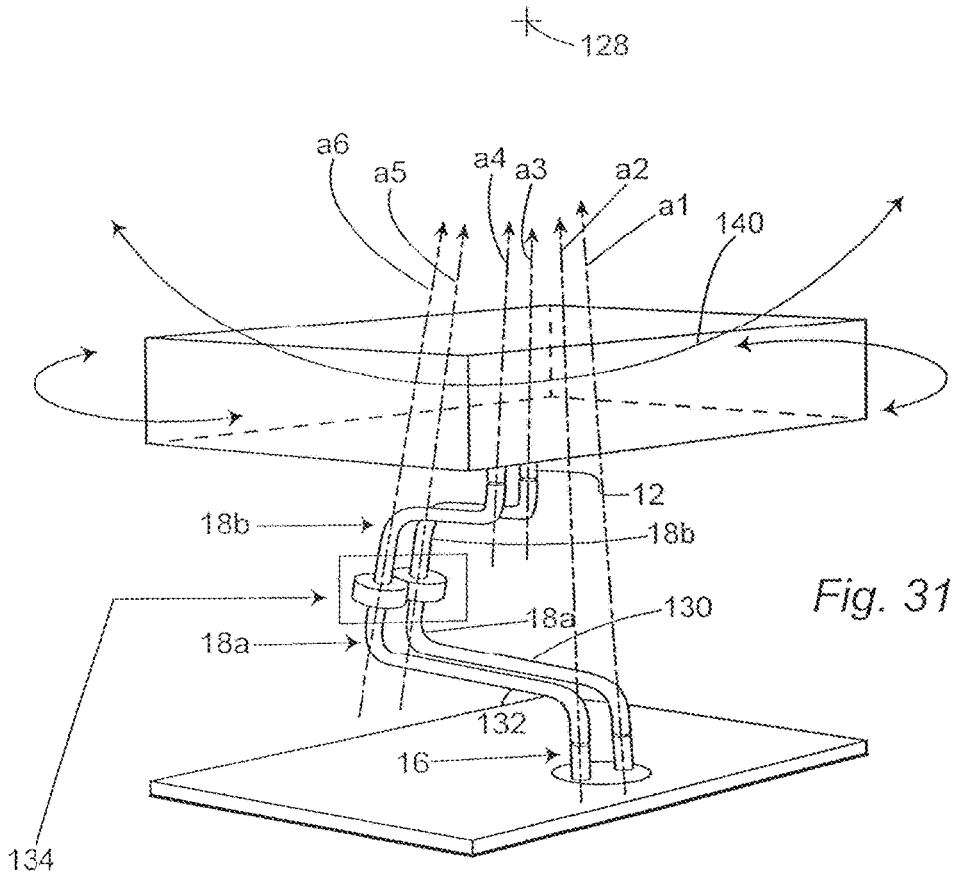
FIG. 31 is a perspective view of another form of human support assembly.

In FIG. 31, a further modified form of structure is depicted with more specific forms of link members 18*a*, 18*b*. Formed tubes define the link members 18*a*, 18*b*. All of the pivot axes a1, a2, a3, a4, a5, a6 converge to a single pivot point 128.

A synchronizing mechanism at 134 avoids binding or locking up due to over center positioning as the separate, similarly shaped, tubular configurations move towards a planar relationship. Again, this avoids a non-smooth movement of the support in any portion of the desired travel range.

Figure 32:
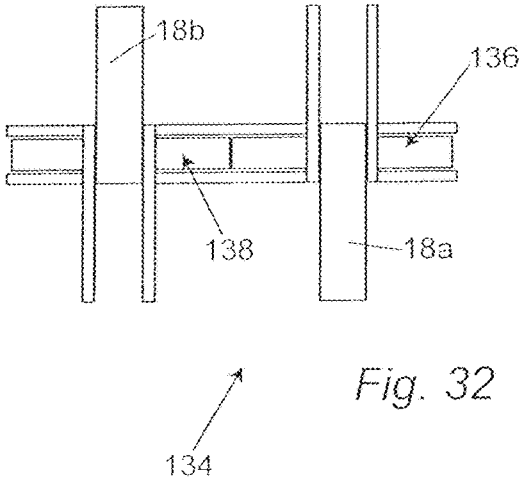
FIGS. 32-34 are fragmentary views showing different synchronizing structures for controlling relationship between link members on the structure in FIG. 31 as the support thereon is moved.

The synchronizing mechanism 134, shown in further detail in FIG. 32, may include cooperating components 136, 138, fixed respectively to the link members 18*a*, 18*b* on the tubes 130, 132, respectively. The components 136, 138 interact to coordinate movement of the link members 18*a*, 18*b* as the support 12 swings in a curved path, as indicated by the double-headed arrow 140. The components 136, 138 can be gears, pulleys, chains, belts, etc.

The synchronizing mechanism 134 could be incorporated at other locations to achieve the same objective.

Figure 33:
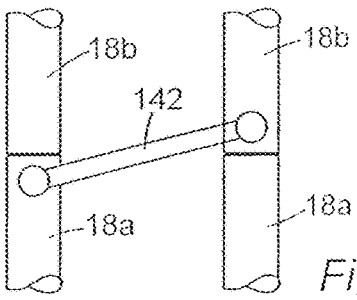
Figure 34:
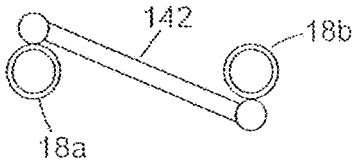

In one alternative form, as shown in FIGS. 33 and 34, a link member 142 has its ends pivotably to the link members 18*a*, 18*b* on the separate tubes 130, 132 to effect the desired synchronization.

Figure 35:
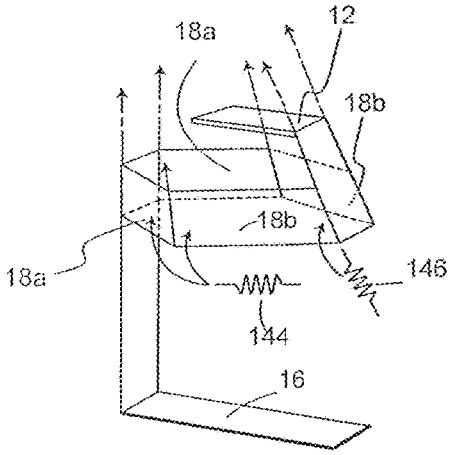
FIG. 35 is a schematic representation of spring members acting between the link members, support, and/or base to control and facilitate relative movement therebetween.

As shown schematically in FIG. 35, springs 144, 146 may connect between any of the components 18*a*, 18*b*, 12, 16 in a manner to assist counterbalancing and/or relative movement between components. The springs 144, 146 may act against a separate base or between any of the components, as described above, to effect the desired force transmission. The springs 144, 146 may be strategically placed compression springs or torsion springs. The springs 144, 146 may maintain an equilibrium position for components or may assist or control relative movement therebetween.

Figure 36:
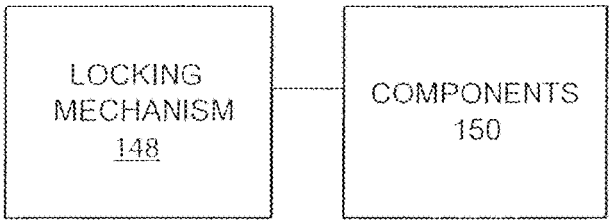
FIG. 36 is a schematic representation of a mechanism for locking relatively movable components on the inventive human support structure.

As shown in FIG. 36, a locking mechanism 148 may be incorporated to maintain the relationship between any two components on the structure or control relative movement therebetween. The components, identified in FIG. 37 generically at 150, include all components that move or are situated to have another component move relative thereto in operation.

As one example, it may be desired to fix the body 84 against movement, as when an infant is sleeping. The locking mechanism 148 may thus act between any of the components 150 to prevent any movement of the body 84 relative to the base 16. The locking mechanism 148 may be releasediunlocked to allow normal movement of the body 84.

The locking mechanism 148 might alternatively be configured to control the permitted range of the non-linear path as by strategically blocking relative movement between components.

Figure 37:
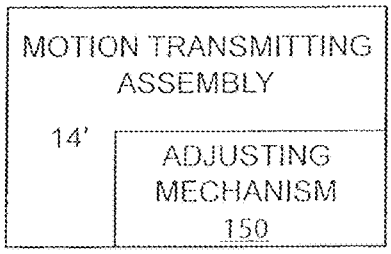
FIG. 37 is a schematic representation of an adjusting mechanism for link members, the support, and/or base to alter the operating characteristics of the associated human support structure.

As shown schematically in FIG. 37, the motion transmitting assembly 14', which is intended to be generic to all motion transmitting assemblies herein described and others, may incorporate an adjusting mechanism 150. The adjusting mechanism 150 may be configured as to change the angle between any of the pivot axes between the relatively movable support 12, base 16, and link members 18.

The adjusting mechanism 150 may also be configured so that the effective length/radius along any axis between any of the support 12, base 16, and link member 18 and the pivot location to which the respective axis is aligned towards, can be changed. This allows the effective radius of any arc in which a support 12 moves to be changed selectively as desired.

The adjusting and locking mechanisms 150, 148 may incorporate different conventional type components, such as gears, levers or linkages, Bowden cables with a lever, kick stands, ratchets, sliding connecting rods, toothed members, magnetically attracted components, etc. Arc length might be changed using components such as a crank, rack and pinion, slider, telescoping members, roller and track mechanism, gas cylinder, etc. Alternatively, linkage ends might be connected at different locations.

Any of the generically depicted connectors 20, 22, 24, 26 may interact so that they can be selectively separated to facilitate folding and compaction of the overall structure.

As shown schematically at 152 in FIG. 2, a powered drive 152 may be incorporated to change the relative positions between the support 12, base 16, and link members 18. The support 12 may thus be driven in its non-linear path in a back and forth motion without requiring any effort to be expended by a user.

To avoid excessive freedom of movement, a damping structure 152 may be incorporated, as shown schematically in the exemplary motion transmitting assembly 14 in FIG. 8. The damping structure 152 may simply bind relative movement between a link member 18 and one or both of the support 12 and base 16 to thereby avoid excessive freedom of movement. As but one example, a rubber bushing might be utilized.

For each embodiment wherein the axes converge towards a single pivot location, a modification might be made so that one or more of the axes go towards/converge towards a second pivot location. Similarly, those embodiments with multiple pivot locations might be modified to have a single pivot location, or have one or more axes changed to go through a different one of the multiple pivot locations.

Figure 38:
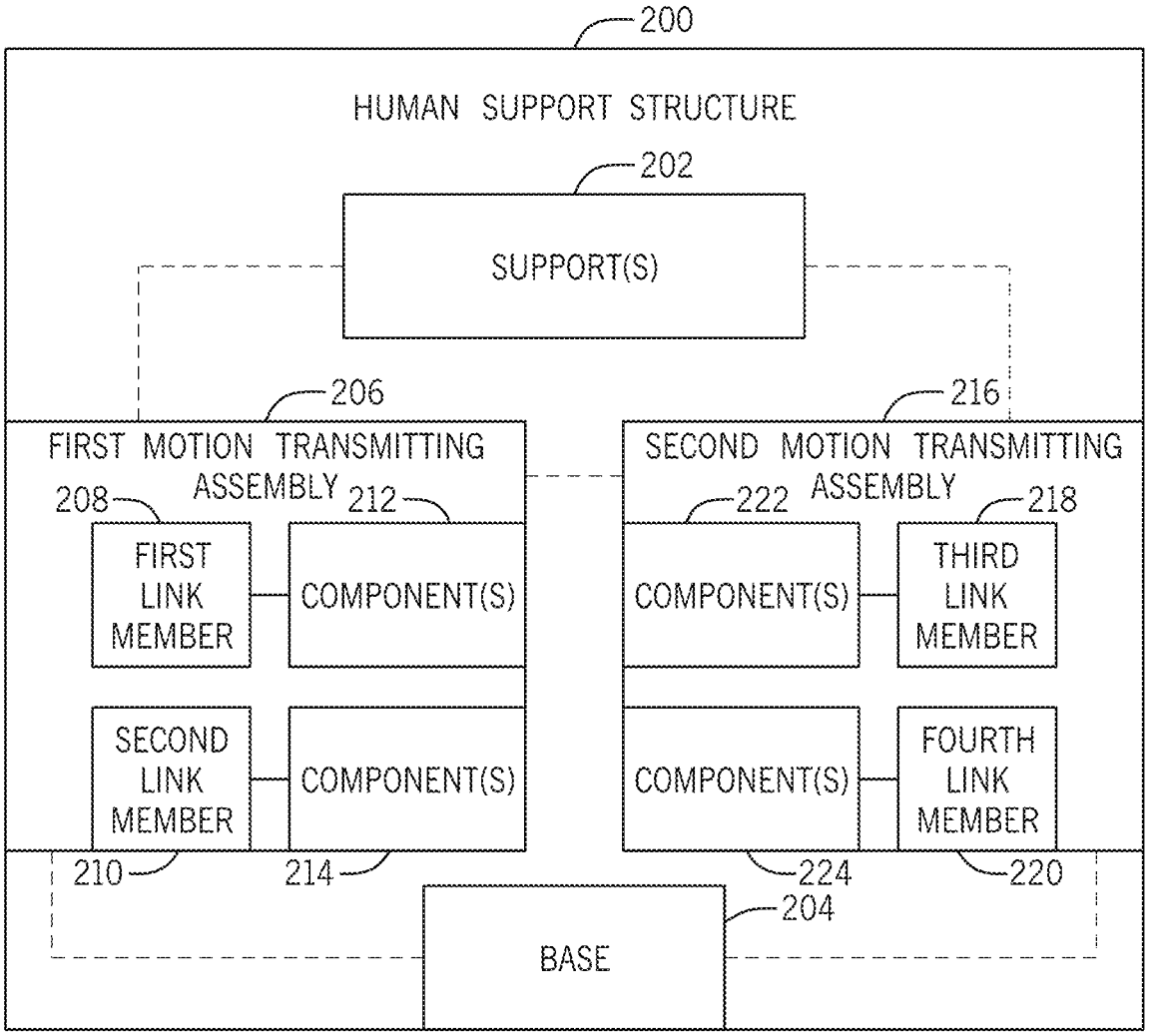
FIG. 38 is a schematic representation of a modified form of human support structure, according to the present invention, and including first and second motion transmitting assemblies that control movement of at least one support relative to a base.

In FIG. 38, a human support structure, according to the present invention, is shown schematically at 200.

The human support structure 200 has at least one support 202 against which at least one part of a human body can be borne in use. While not so limited, the support 202 may be in the form of a seating surface, an armrest, a back support, etc.

The human support structure 200 further includes a base 204, which may be either an integrated assembly or an underlying surface upon which the self-contained human support structure 200 is placed for use. For simplicity the base 204 is depicted in the former configuration and will be considered to encompass the latter.

A first motion transmitting assembly 206 is made up of first and second link members 208, 210, respectively, joined to each other for pivoting movement around a first shared axis. The first and second link members 208, 210 together define a first unit.

The first link member 208 is joined to at least one component 212 for pivoting movement around a first axis. The second link member 10 is joined to at least one component 214 for pivoting movement around a second axis.

A second motion transmitting assembly 216 has a third link member 218 and a fourth link member 220 joined to each other for pivoting movement around a second shared axis. The third and fourth link members 218, 220 together define a second unit.

The third link member 218 is joined to at least one component 222 for pivoting movement around a third axis. The fourth link member 220 is joined to at least one component 224 for pivoting movement around a fourth axis.

The schematic representation is intended to encompass a wide range of different structures, with those described hereinbelow being exemplary in nature only. The generic showing is intended to encompass variations of each component and different interactions therebetween.

What is basic in this particular embodiment is that the first and second motion transmitting assemblies 206, 216 cooperate between at least one of: a) each other; b) at least two of the at least one support 202; and c) the base 204 and at least one support 202 to guide relative movement between the at least one support 202 and the base 204. The human support structure 200 is configured so that the first and second units, respectively made up of the first and second link members 208, 210 and the third and fourth link members 218, 220, can be selectively and controllably relatively repositioned to change how guided relative movement between the at least one support 202 and base 204 can occur.

The support 202, as shown schematically in FIG. 38, encompasses virtually any type of human support structure with the user in a sitting or prone position. For example, the generically depicted support 202 encompasses a seat, an armrest, a back support, a cradle for an infant, etc. Virtually any surface on the support, against which a human body part rests with the user in an operative position, and which can be repositioned, is intended to be encompassed by the generic showing of the support 202 in FIG. 38.

As noted, the generic showing of components and their interaction is intended to be broad in scope, with the exemplary embodiments described hereinbelow not limiting in nature.

Figure 39:
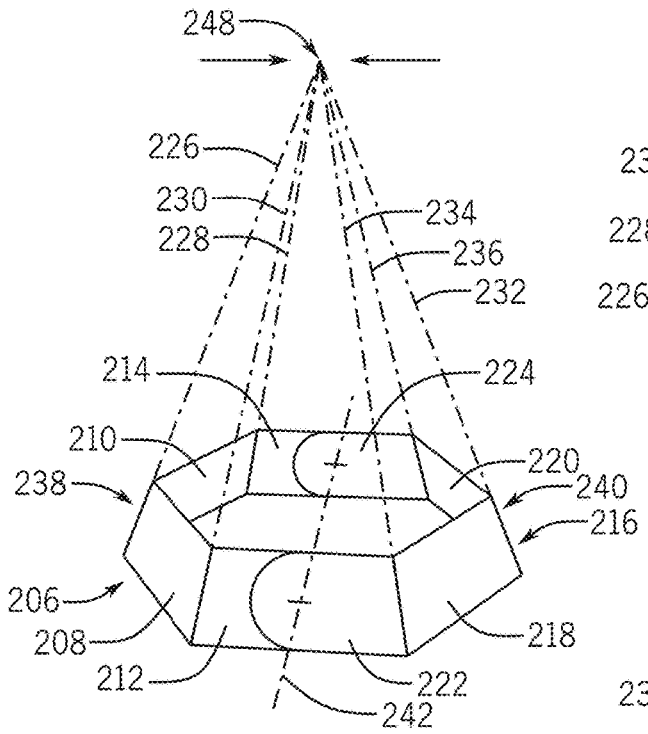
FIG. 39 is a partially schematic representation showing further details of the motion transmitting assemblies in FIG. 38 and with the motion transmitting assemblies in a first relationship.
Figure 40:
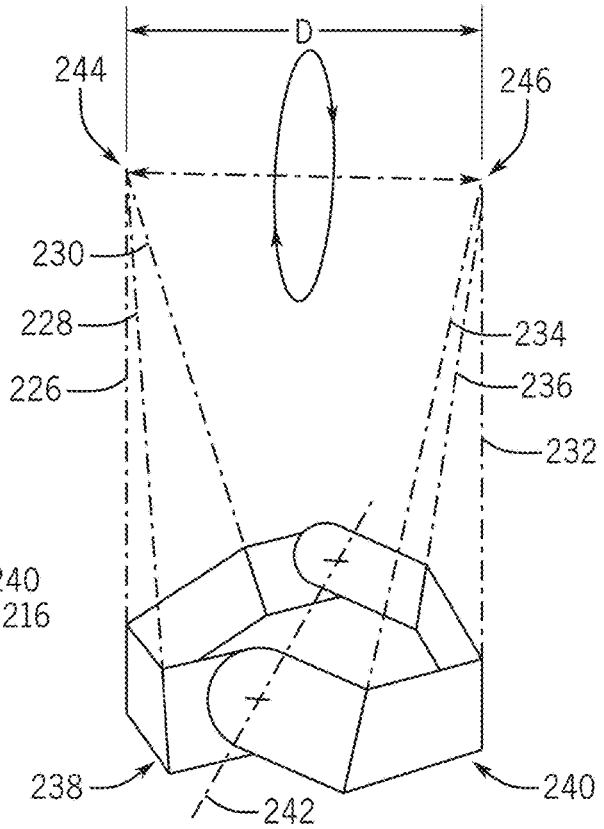
FIG. 40 is a view as in FIG. 39 wherein the motion transmitting assemblies have been relatively repositioned.

Referring now to FIGS. 39 and 40, more specific components within the generic showing of FIG. 38 are depicted as usable in any of the previously described constructions—cradle, sitting apparatus, with or without back support and/or armrests, etc, The first motion transmitting assembly 206 consists of the first link member 208 and second link member 210 joined to each other for pivoting movement around a first shared axis 226. The first link member 208 is joined to the component 212 for pivoting movement around a first axis 228. The second link 210 is joined to the component 214 for pivoting movement around a second axis 230.

The second motion transmitting assembly 216 consists of the third and fourth link members 218, 220, respectively, joined to each other for pivoting movement around a second shared axis 232. The third link member 218 is joined to the component 222 for pivoting movement around a third axis 234. The fourth link member 220 is joined to the component 224 for pivoting movement around a fourth axis 236.

In this embodiment, the first and second link members 208, 210, and the components 212, 214, together make up the aforementioned first unit 238. The third and fourth link members 218, 220 and components 222, 224, together make up the aforementioned second unit 240.

In this embodiment, the first and second units 238, 240 cooperate with each other through a pivot connection between the components 212, 222 and 214, 224 which allows the first and second units 238, 240 to pivot guidingly relative to each other around an axis 242.

The axes 226, 228, 230 on the first unit 238 converge towards a first location/point at 244 with the axes 232, 234, 236 on the second unit 240 converging towards a second location/point 246. It should be understood that converging "towards" the locations 244, 246 does not require that the axes converge precisely to a point. The structure will operate with the axes converging generally towards the same locations.

With the embodiment depicted, the first and second units 238, 240 are pivotable between the FIG. 39 position and the FIG. 40 position. In FIG. 39, the pivot locations 244, 246 converge towards each other to a common location at 248 whereas in FIG. 40, the locations 244, 246 are spaced a distance D away from each other.

In this embodiment, the paired components 212, 222 may act against, or make up part of, one of the support 202 and base 204, with the paired components 212, 222 acting against, or making up part of, the other of the support 202 and base 204.

Figure 41:
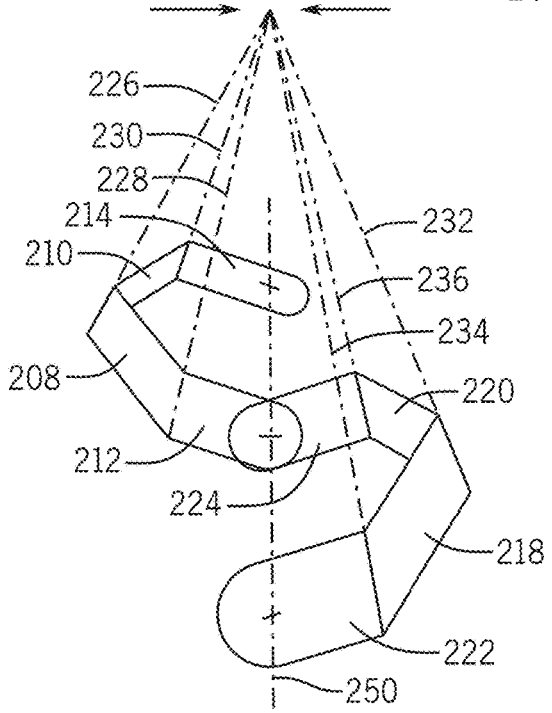
FIG. 41 is a view as in FIG. 39 wherein the motion transmitting assemblies are engaged in a different manner.
Figure 42:
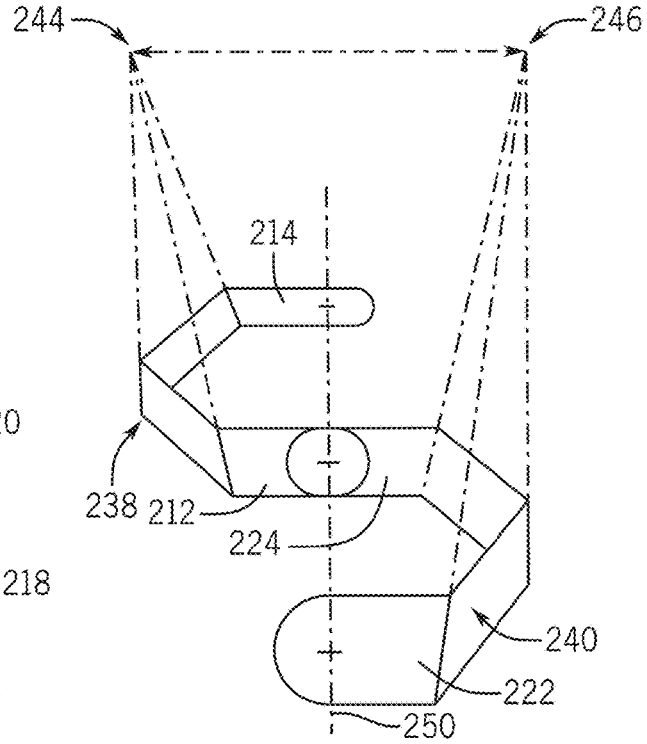
FIG. 42 is a view as in FIG. 41 with the motion transmitting assemblies repositioned relative to each other.

FIGS. 41 and 42 show the same first and second units 238, 240 joined in a different manner for pivoting relative to each other around an axis 250.

In this embodiment, the components 212, 224 are connected directly to each other. The combined components 212, 224 may act against, or make up part of, one of the support 202 and base 204, with the components 214, 222 cooperatively acting against, or making up part of, the other of the support 202 and base 204. The spaced interaction of the components 214, 222 allows a stabilized arrangement to be designed.

The converging axes are movable between the FIGS. 41 and 42 relationships, corresponding respectively to the relationships in FIGS. 39 and 40.

Figure 43:
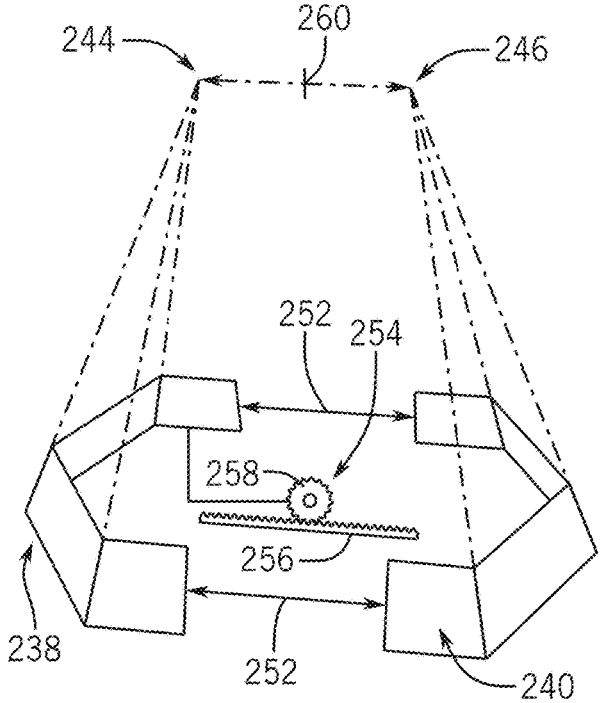
FIG. 43 is a view as in FIGS. 39-42 and showing a drive for relatively repositioning the motion transmitting assemblies.

In FIG. 43, a modified arrangement is shown wherein the first and second units 238, 240 are translated guidingly, selectively towards and away from each other, as indicated by the double-headed arrows 252. A drive at 254 moves at least one of the first and second units 238, 240 relative to the other of the first and second units 238, 240 to effect repositioning therebetween. In this embodiment, the drive 254 consists of a toothed rack 256 associated with the second unit 240 and a cooperating pinion gear 258 associated with the first unit 238. The rack and pinion arrangement operates in conventional fashion whereby turning of the pinion gear 258 in one direction causes the first and second units 238, 240 to move towards each other, and in the opposite direction causes the first and second units 238, 240 to move away from each other.

The location at 260 represents a starting neutral position wherein the first and second locations 244, 246 are the same.

Figure 44:
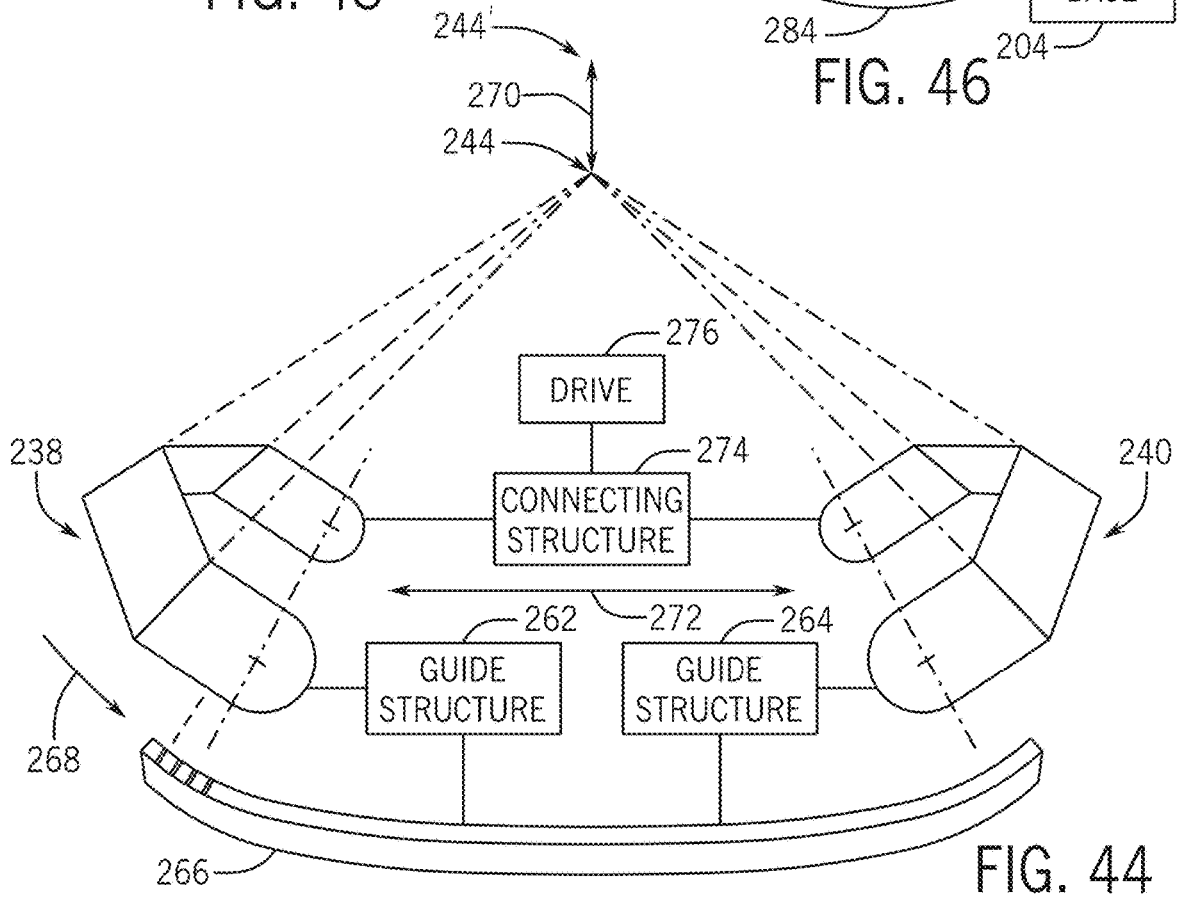
FIG. 44 is a view as in FIG. 43 and showing a different system for repositioning the motion transmitting assemblies in FIGS. 39-43.

In an alternative embodiment, as shown in FIG. 44, the first and second units 238, 240 have guide structures 262, 264, respectively, which cooperate with a contoured guide rail 266. As the guide structure 262 moves along the rail 266 from the solid line position in FIG. 44 in the direction of the arrow 268, the first converging axis location at 244 is shifted upwardly along the line indicated by the double-headed arrow 270 to a different position identified as 244'.

The second unit 240 cooperates with the guide rail 266 in the same manner as it moves towards and away from the first unit 238, as indicated by the double-headed arrow 272.

Connecting structure 274, cooperating between the first and second units 238, 240, may synchronize their movement. A drive 276 may control movement of the first and second units 238, 240 and may take virtually any known form. This same type of generic drive 276 is contemplated for all embodiments.

Figure 45:
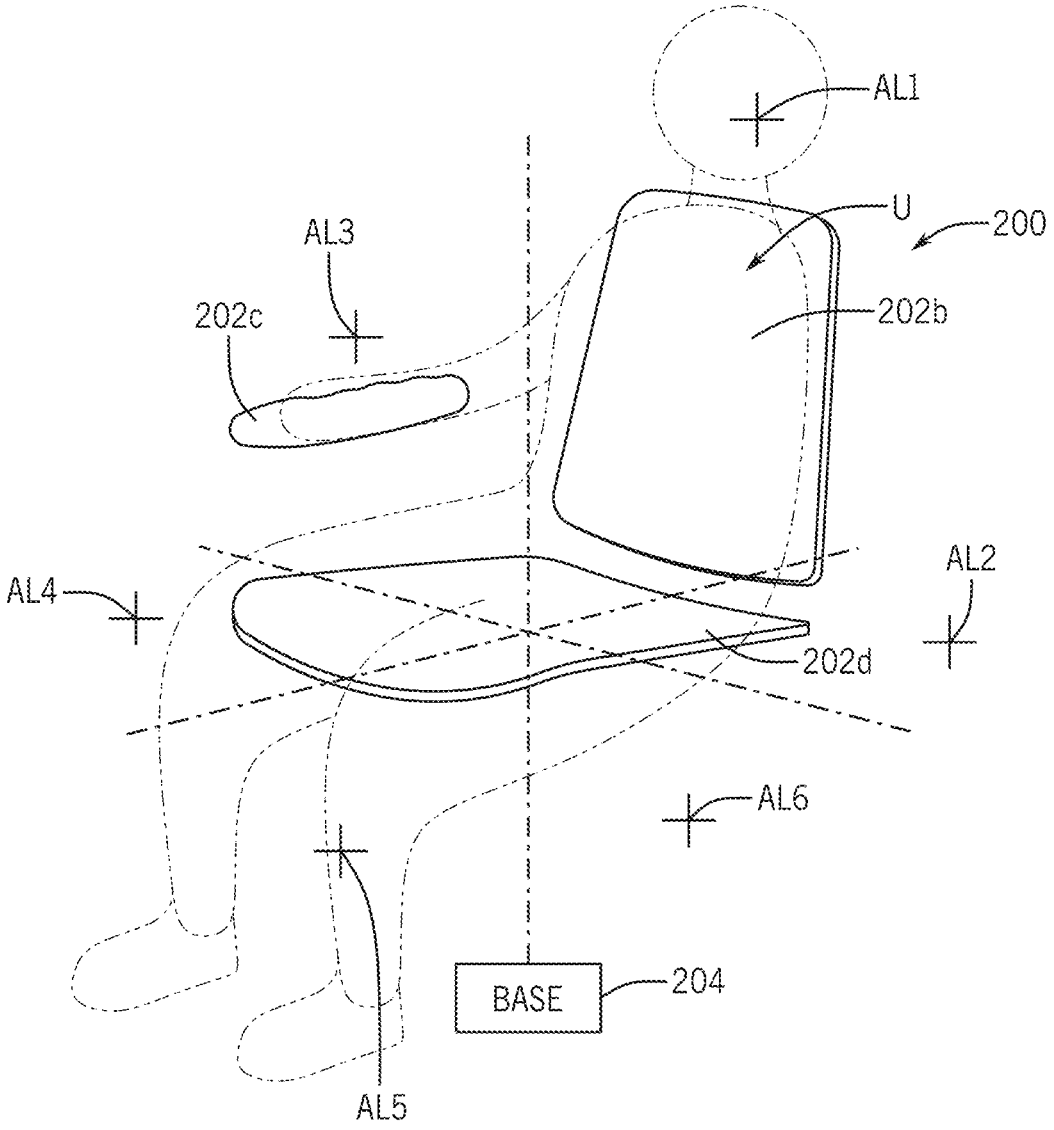
FIG. 45 is a schematic representation of a human support structure and showing different potential converging axes locations for the different link member arrangements as shown in FIGS. 38-44.

In FIG. 45, a basic sitting apparatus is shown at 200 representing but one form of the human support structure 200 shown generically in FIG. 38. As depicted, the support 202*a* is in the form of the primary sitting surface upon which a user U bears his/her weight when assuming a normal sitting position as shown in dotted lines in FIG. 45. A separate support 202*b* is in the form of a back support, with a third support 202*c* in the form of an armrest. The depicted base 204 may be a part of the sitting apparatus 200 or structure to which the self-contained sitting apparatus 200 is attached.

FIG. 45 shows six different general converging axis locations, AL1-AL6, which may result from the selected structure and are changeable through the arrangements as hereinabove described and in one additional embodiment in FIG. 46.

Figure 46:
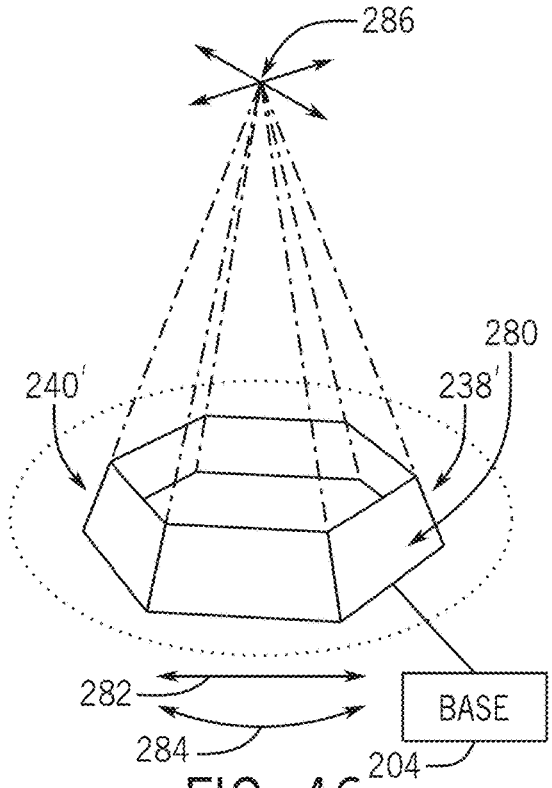
FIG. 46 is a view as in FIGS. 39-43 and showing another version of a motion transmitting system that has a changeable converging axis location.

In FIG. 46, a unit 280, having as an exemplary form that effectively integrates both units 238, 240, is designed to be repositionable relative to the base 204 as by translation, indicated by the double-headed arrow 282, or by pivoting, as indicated by the double-headed arrow 284, to change the location of, in this case, the common axial converging location at 286 relative to the base 204.

For purposes of consistency with the claims, the unit 280 will be considered to be made up of corresponding first and second units 238', 240' with the interacting components 212, 222 and 214, 224 being shared.

Structure might be designed so as to additionally allow the location 286 to be changed in multiple dimensions, including vertically as well as multiple horizontal directions.

In FIGS. 47-52, different arrangements are shown for joining link members LM1, LM2 for relative pivoting movement.

Figure 47:
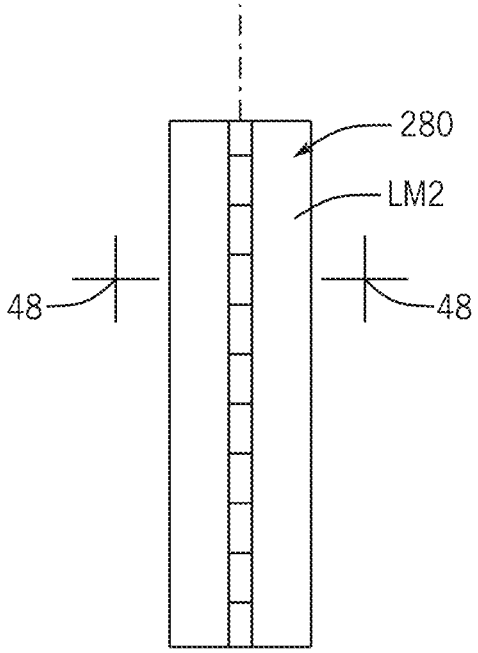
FIG. 47 is a plan view of a hinge usable to connect link members for pivoting movement relative to each other.
Figure 48:
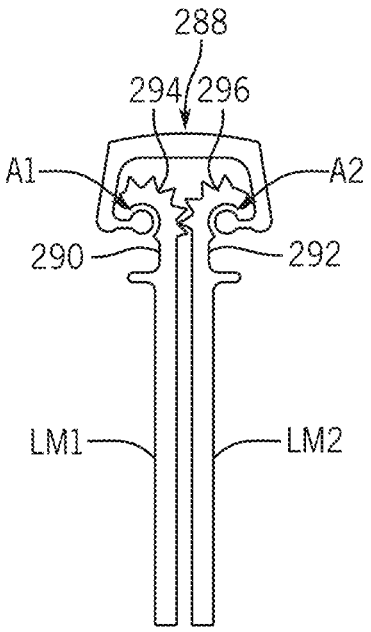
FIG. 48 is a cross-sectional view of the hinge taken along line 48-48 of FIG. 47 and with link members attached thereto.

In FIGS. 47 and 48, a hinge 288 is shown having cooperating panels 290, 292 connected one each to the link members LM1, LM2. The panels 290, 292 have cooperating gear teeth 294, 296 which guide pivoting movement of the respective panels 290, 292 together with their associated link members LM1, LM2 around adjacent, parallel axes A1, A2.

This type of hinge 288 is desirable from the standpoint that the panels 290, 292 and coextensive gears 294, 296 can be formed by an extrusion process and provide a stable interaction along the entire hinge length.

Figure 49:
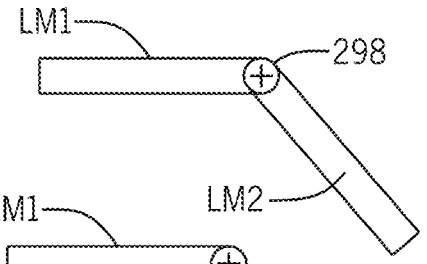
FIGS. 49-52 show alternative forms of connections between relatively pivotable link members.
Figure 50:
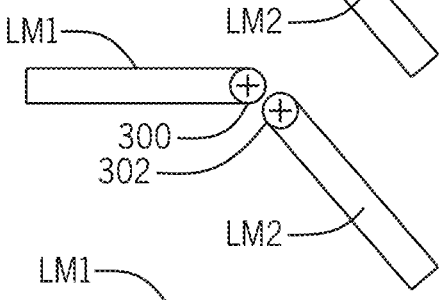

In FIG. 49, the link members are connected through a common pivot pin 298, whereas in FIG. 50 there are separate pivot pins 300, 302 for the link members LM1, LM2, respectively.

Figure 51:
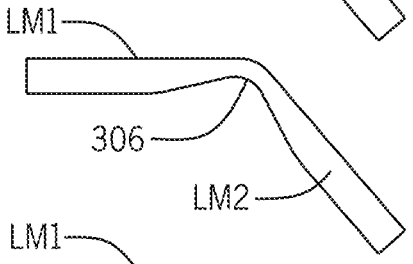
Figure 52:
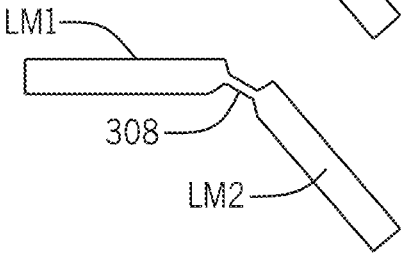

FIGS. 51 and 52 show live hinge arrangements between the link members LM1, LM2 with a locally reduced thickness to produce an integral bendable region at 306, 308, respectively.

By adjusting the pivot location to a new location in space, a body support device, such as a swing, seat, or rocker, and the like, is moved in a specific manner. Adjustment is controlled by a user via a hand-wheel, crank, lever, or some other method, or may be electronically controlled via a motor, for example, For example, the pivot height, or location, can be adjusted to change the period of motion. This provides customization to meeting the "soothing" needs of babies that require different motions, or for adults who find a quick moment more energizing.

Furthermore, by separating the axes, the motion may be constrained in one single plane of movement. This is in contrast to the convergence of all axes, in which case, the support device may be free to move in all directions.

In an office, classroom, or gaming environment, and the like, the user can benefit by tailoring their desired movement by adjusting the location of the pivots. There are many ways to achieve this—not limited to the methods shown in the drawings. Reorienting the axes and pointing them towards a new location changes the motion.

The foregoing disclosure of specific embodiments is intended to be illustrative of the broad concepts comprehended by the invention.

The invention claimed is:

1. A human support structure comprising:

at least one support configured to support at least one part of a human body; a base;

a first motion transmitting assembly comprising first and second link members joined to each other for pivoting movement around a first shared axis and defining a first unit;

the first link member joined to a component for pivoting movement around a first axis, the second link member joined to a component for pivoting movement around a second axis;

a second motion transmitting assembly comprising third and fourth link members joined to each other for pivoting movement around a second shared axis and defining a second unit, the third link member joined to a component for pivoting movement around a third axis, the fourth link member joined to a component for pivoting movement around a fourth axis, the first and second motion transmitting assemblies cooperating between at least one of: a) each other; b) at least two of the at least one support; and c) the base and at least one support to guide relative movement between the at least one support and the base, the human support structure configured so that the first and second units are selectively and controllably relatively repositionable, while maintaining a relative position of: a) the first and second link members on the first unit; and b) the third and fourth link members on the second unit, to change how relative movement between the at least one support and base is guided, wherein at least one of: a) the first shared axis; b) the first axis; and c) the second axis is non-parallel to another of: a) the first shared axis; b) the first axis; and c) the second axis, wherein the first shared axis and the first axis have a fixed relationship.

2. The human support structure according to claim 1 wherein the human support structure is configured so that the first and second units can be selectively and controllably relatively repositioned by pivoting at least one of the first and second units relative to the other of the first and second units.

3. The human support structure according to claim 1 wherein the human support structure is configured so that the first and second units can be selectively and controllably relatively positioned by translating at least one of the first and second units relative to the other of the first and second units.

4. The human support structure according to claim 1 wherein the support is one of: a) a seat; b) an armrest; c) a back support surface; and d) a cradle for an infant.

5. The human support structure according to claim 1 wherein the first unit comprises additionally the components to which the first and second link members are joined.

6. The human support structure according to claim 5 wherein the second unit comprises additionally the components to which the third and fourth link members are joined.

7. The human support structure according to claim 6 wherein one of the components to which one of the first and second link members is joined is pivotably connected to one of the components to which one of the third and fourth link members is joined in a manner to allow the first and second units to be relatively repositioned.

8. The human support structure according to claim 1 further comprising a drive for moving at least one of the first and second units to thereby effect relative repositioning of the first and second units.

9. A human support structure comprising:

at least one support configured to support at least one part of a human body;

a base;

a first motion transmitting assembly comprising first and second link members joined to each other for pivoting movement around a first shared axis and defining a first unit;

the first link member joined to a component for pivoting movement around a first axis, the second link member joined to a component for pivoting movement around a second axis;

a second motion transmitting assembly comprising third and fourth link members joined to each other for pivoting movement around a second shared axis and defining a second unit, the third link member joined to a component for pivoting movement around a third axis, the fourth link member joined to a component for pivoting movement around a fourth axis, the first and second motion transmitting assemblies cooperating between at least one of: a) each other; b) at least two of the at least one support; and c) the base and at least one support to guide relative movement between the at least one support and the base, the human support structure configured so that the first and second units can be selectively and controllably relatively repositioned to change how relative movement between the at least one support and base is guided, wherein the first and second axes converge towards a first point.

10. The human support structure according to claim 9 wherein the third and fourth axes converge towards a second point.

11. The human support structure according to claim 9 wherein the human support structure is configured so that the first location can be selectively changed.

12. The human support structure according to claim 9 wherein the third and fourth axes converge towards the first point.

13. The human support structure according to claim 12 wherein the human support structure is configured so that the first location can be selectively changed.

14. A human support comprising:

at least one support configured to support at least one part of a human body;

a base;

a first motion transmitting assembly comprising first and second link members joined to each other for pivoting movement around a first shared axis and defining a first unit;

the first link member joined to a component for pivoting movement around a first axis, the second link member joined to a component for pivoting movement around a second axis;

a second motion transmitting assembly comprising third and fourth link members joined to each other for pivoting movement around a second shared axis and defining a second unit, the third link member joined to a component for pivoting movement around a third axis, the fourth link member joined to a component for pivoting movement around a fourth axis, the first and second motion transmitting assemblies cooperating between at least one of: a) each other; b) at least two of the at least one support; and c) the base and at least one support to guide relative movement between the at least one support and the base, the human support structure configured so that the first and second units can be selectively and controllably relatively repositioned to change how relative movement between the at least one support and base is guided, wherein the first unit comprises additionally the components to which the first and second link members are joined, wherein the second unit comprises additionally the components to which the third and fourth link members are joined, wherein one of the additional components to which one of the first and second link members is joined is pivotably connected to one of the additional components to which one of the third and fourth link members is joined in a manner to allow the first and second units to be relatively repositioned, wherein only one of the additional components on the first unit is connected directly to the second unit.

15. A human support structure comprising:

at least one support configured to support at least one part of a human body; a base;

a first motion transmitting assembly comprising first and second link members joined to each other from pivoting movement around a first shared axis and defining a first unit;

the first link member joined to a component for pivoting movement around a first axis, the second link member joined to a component for pivoting movement around a second axis, a second motion transmitting assembly comprising third and fourth link members joined to each other for pivoting movement around a second shared axis and defining a second unit, the third link member joined to a component for pivoting movement around a third axis, the fourth link member joined to a component for pivoting movement around a fourth axis, the first and second motion transmitting assemblies cooperating between at least one of: a) each other; b) at least one of the at least one support; and c) the base and at least one support to guide relative movement between the at least one support and the base, wherein the first and second axes converge towards a first point and the human support structure is configured so that the first point can be changed.

16. The human support structure according to claim 15 wherein the third and fourth axes converge towards the first point.

17. The human support structure according to claim 15 wherein the human support structure has a seating surface and the human support structure is configured so that the first location can be changed relative to a user in a sitting position on the seating surface.

18. The human support structure according to claim 17 wherein the human support structure is configured so that the first location can be shifted both vertically and horizontally relative to a user in a sitting position on the seating surface.

19. The human support structure according to claim 15 wherein the component to which the first link member connects makes up part of the base and the component to which the second link member connects makes up part of the at least one support.

20. The human support structure according to claim 19 wherein the component to which the third link member connects makes up part of the base and the component to which the fourth link member connects makes up part of the at least one support.

* * * * *